US008657173B2

(12) United States Patent
Uejima et al.

(10) Patent No.: US 8,657,173 B2
(45) Date of Patent: Feb. 25, 2014

(54) PORTABLE TYPE FASTENER DRIVING TOOL

(75) Inventors: Yasutsugu Uejima, Osaka-fu (JP); Keiji Yamakawa, Osaka-fu (JP)

(73) Assignee: Japan Power Fastening Co,. Ltd., Osaka-Shi (JP)

( * ) Notice: Subject to any disclaimer, the term of this patent is extended or adjusted under 35 U.S.C. 154(b) by 1463 days.

(21) Appl. No.: 10/599,246

(22) PCT Filed: Mar. 30, 2005

(86) PCT No.: PCT/IB2005/000823

§ 371 (c)(1),
(2), (4) Date: Apr. 8, 2008

(87) PCT Pub. No.: WO2005/095063

PCT Pub. Date: Oct. 13, 2005

(65) Prior Publication Data

US 2008/0210734 A1 Sep. 4, 2008

(30) Foreign Application Priority Data

Mar. 31, 2004 (JP) ..... 2004-105992

(51) Int. Cl.
*B27F 7/13* (2006.01)
*B25C 5/10* (2006.01)

(52) U.S. Cl.
USPC ..... 227/136; 227/138; 227/137; 227/120

(58) Field of Classification Search
USPC ..... 227/10, 120, 136–138; 81/433, 434
See application file for complete search history.

(56) References Cited

U.S. PATENT DOCUMENTS

| | | | | |
|---|---|---|---|---|
| 2,796,608 | A | | 6/1957 | Johnson |
| 3,628,715 | A | * | 12/1971 | Maynard et al. ..... 227/136 |
| 3,632,032 | A | * | 1/1972 | Termet ..... 227/10 |
| 3,688,966 | A | | 9/1972 | Perkins et al. |
| 3,762,280 | A | * | 10/1973 | Kreuter et al. ..... 92/98 D |
| 3,930,297 | A | | 1/1976 | Potucek et al. |
| 3,945,551 | A | | 3/1976 | Sato et al. |
| 4,363,573 | A | * | 12/1982 | Ginther et al. ..... 406/76 |
| 4,383,608 | A | * | 5/1983 | Potucek ..... 206/347 |
| 4,593,845 | A | | 6/1986 | Andersson et al. |
| 4,619,392 | A | * | 10/1986 | Won ..... 227/120 |
| 4,942,996 | A | * | 7/1990 | Wolfberg et al. ..... 227/136 |
| 5,186,085 | A | * | 2/1993 | Monacelli ..... 81/434 |

(Continued)

FOREIGN PATENT DOCUMENTS

| | | | |
|---|---|---|---|
| EP | 0726122 | A | 8/1996 |
| GB | 593237 | A | 10/1947 |
| JP | 54136478 | A | 10/1979 |
| JP | 05072380 | U | 10/1993 |

*Primary Examiner* — Hemant M Desai
*Assistant Examiner* — Gloria R Weeks
(74) *Attorney, Agent, or Firm* — Lowe Hauptaman & Ham, LLP

(57) ABSTRACT

In a gas combustion type nail driving device, a head part (3) which is disposed on the front surface of the main body is provided with (a) a guide tube (35) through which a rod (17) and a nail n pass; (b) a main guide body (36) on which the guide tube (35) is disposed; (c) a subguide (37) which makes a pair with the main guide body (36) and forms a nail feed space; (d) a feed motor (48); and (e) a gear unit (46) which is driven by the feed motor (47). The nail connecting body N is fed to the guide tube (35) by the feed gear (73).

21 Claims, 23 Drawing Sheets

(56) References Cited

U.S. PATENT DOCUMENTS

| | | | | | |
|---|---|---|---|---|---|
| 5,270,625 | A * | 12/1993 | Neff | 318/560 |
| 5,452,630 | A * | 9/1995 | Haas et al. | 81/434 |
| 5,752,643 | A * | 5/1998 | MacVicar et al. | 227/10 |
| 5,772,098 | A * | 6/1998 | Crutcher | 227/119 |
| 5,794,831 | A | 8/1998 | Velan et al. | |
| 5,904,285 | A * | 5/1999 | Anderson et al. | 227/115 |
| 6,006,975 | A * | 12/1999 | Ishizawa | 227/119 |
| 6,308,880 | B1 * | 10/2001 | Ronconi | 227/119 |
| 6,311,887 | B1 * | 11/2001 | Walter | 227/10 |
| 6,598,777 | B2 * | 7/2003 | Osuga et al. | 227/136 |
| 6,679,410 | B2 * | 1/2004 | Wursch et al. | 227/2 |
| 6,712,255 | B2 * | 3/2004 | Dittrich et al. | 227/10 |
| 6,796,476 | B2 * | 9/2004 | Birk et al. | 227/2 |
| 6,904,834 | B2 * | 6/2005 | Lin | 81/434 |
| 7,000,294 | B2 * | 2/2006 | Kakuda et al. | 227/120 |
| 7,137,186 | B2 * | 11/2006 | Wojcicki et al. | 29/592 |
| 7,225,962 | B2 * | 6/2007 | Porth et al. | 227/136 |
| 7,293,486 | B2 * | 11/2007 | Chang | 81/434 |
| 7,438,206 | B2 * | 10/2008 | Kumayama | 227/127 |
| 7,455,207 | B2 * | 11/2008 | Wojcicki et al. | 227/120 |
| 7,896,212 | B2 * | 3/2011 | Uejima et al. | 227/136 |
| 2004/0112183 | A1 * | 6/2004 | Huang et al. | 81/434 |
| 2006/0112794 | A1 * | 6/2006 | Lai et al. | 81/434 |
| 2009/0114697 | A1 * | 5/2009 | Gross et al. | 227/120 |

* cited by examiner

FIGURE 13
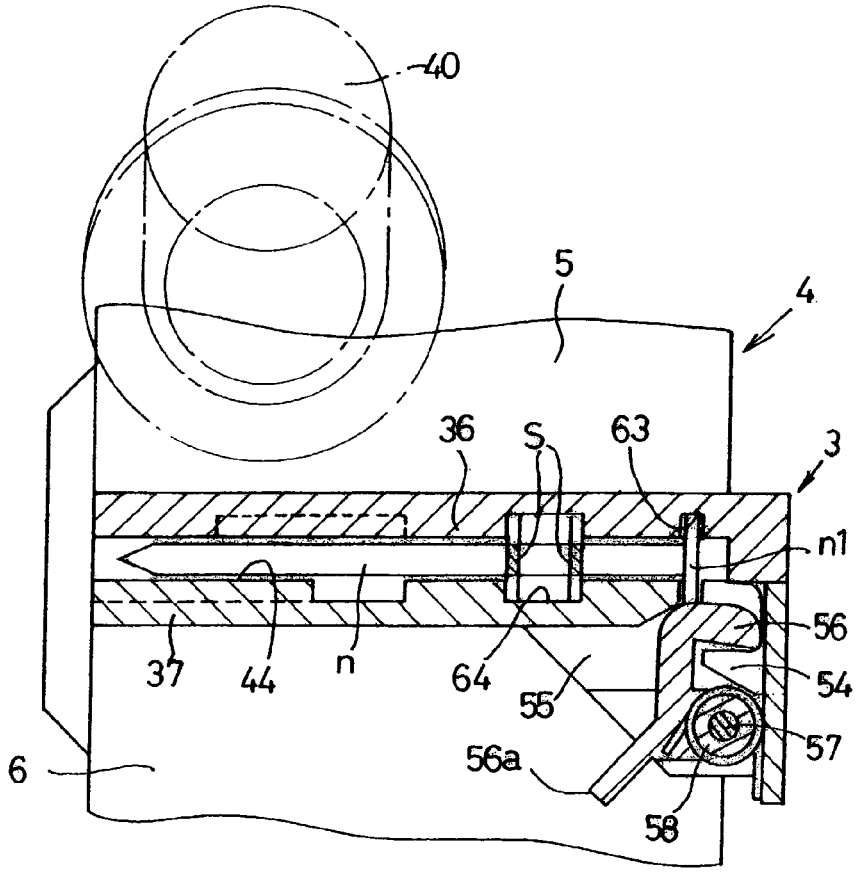
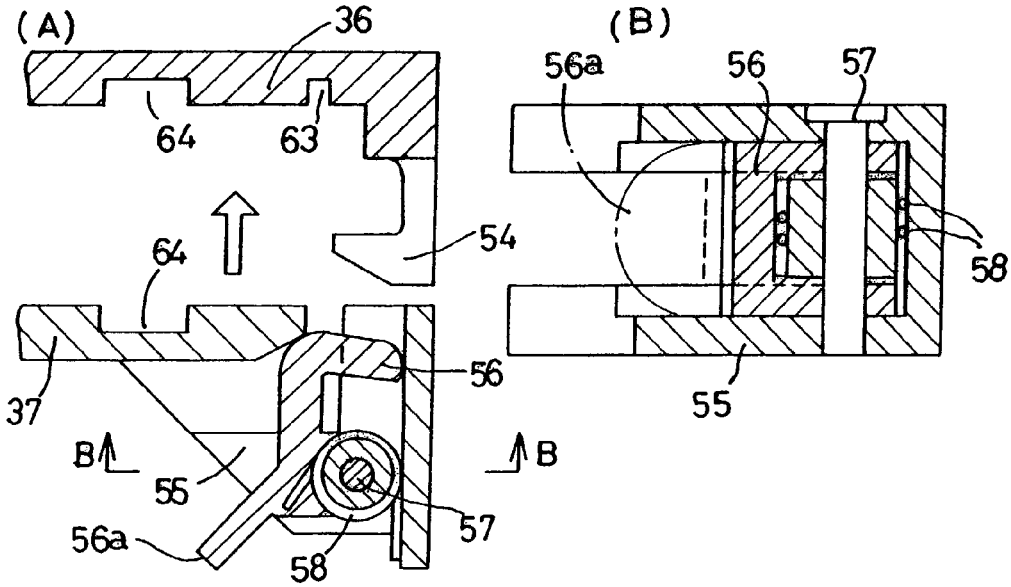
FIGURE 14

FIGURE 20
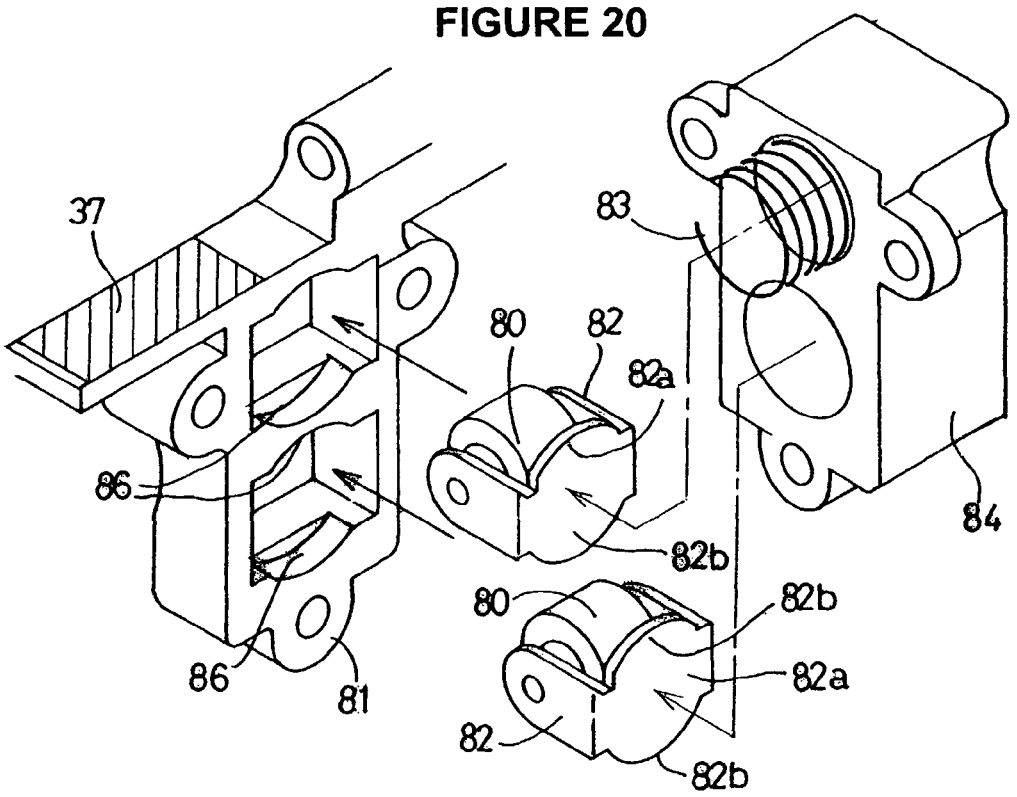
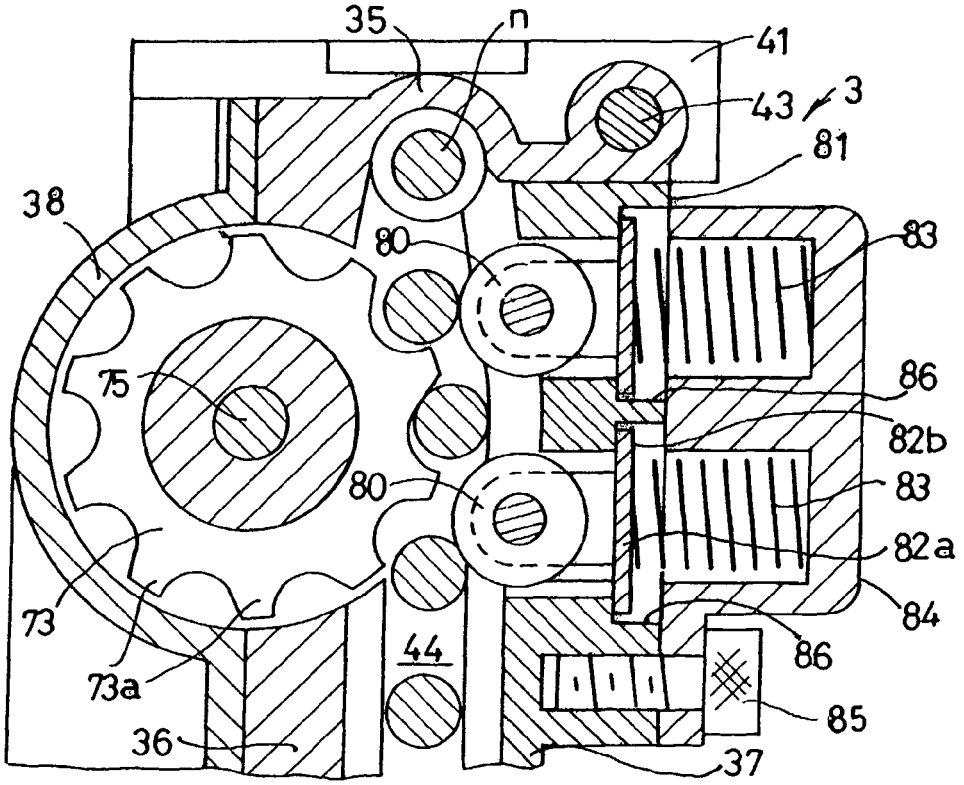
FIGURE 19

FIGURE 21
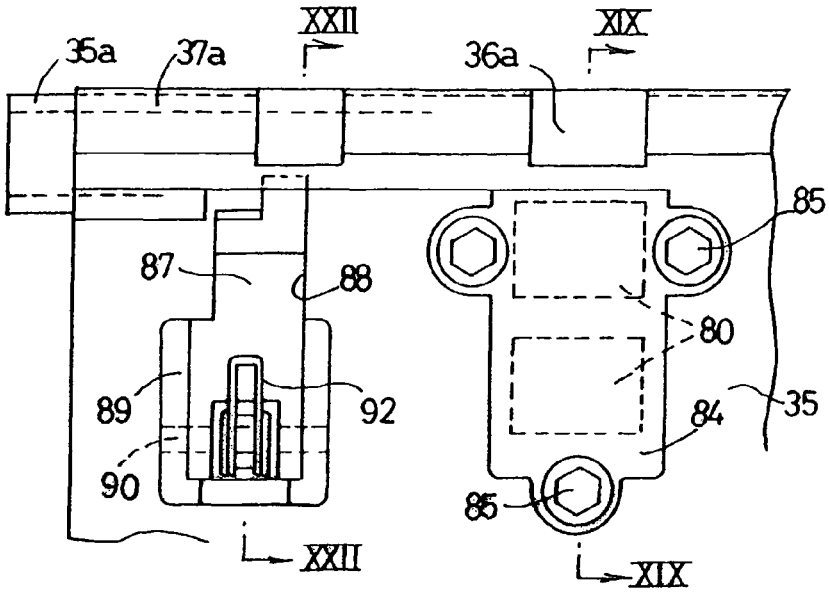
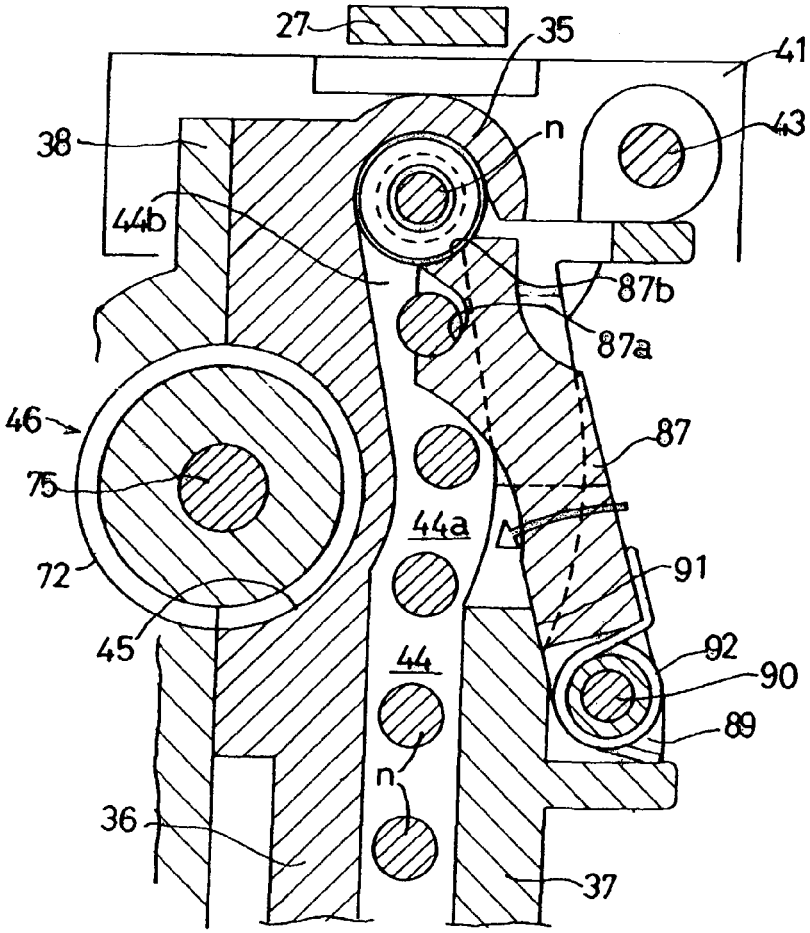
FIGURE 22

FIGURE 23
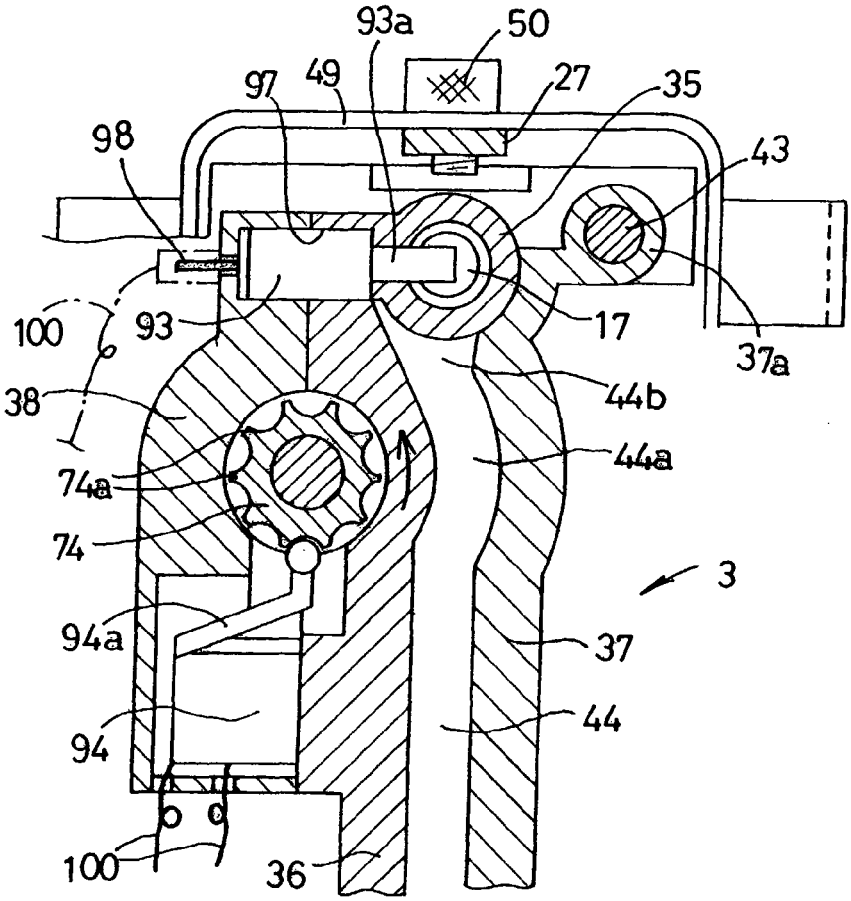
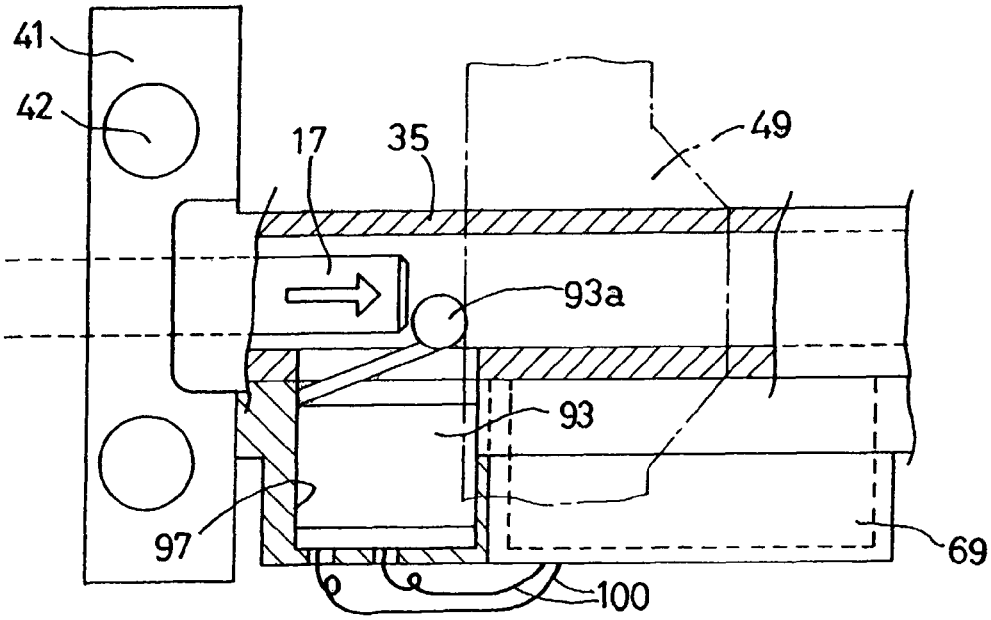
FIGURE 24

FIGURE 25
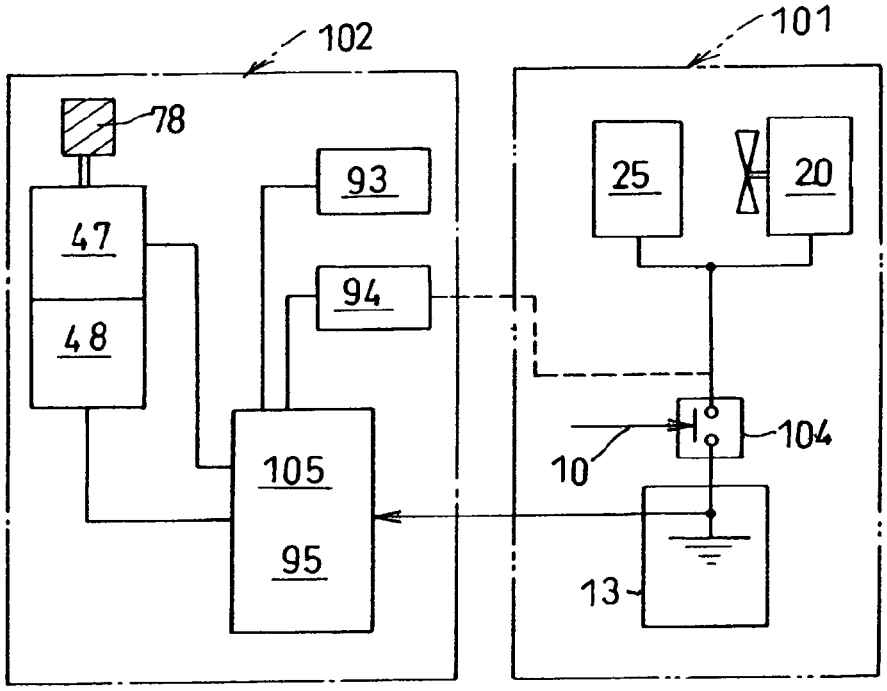
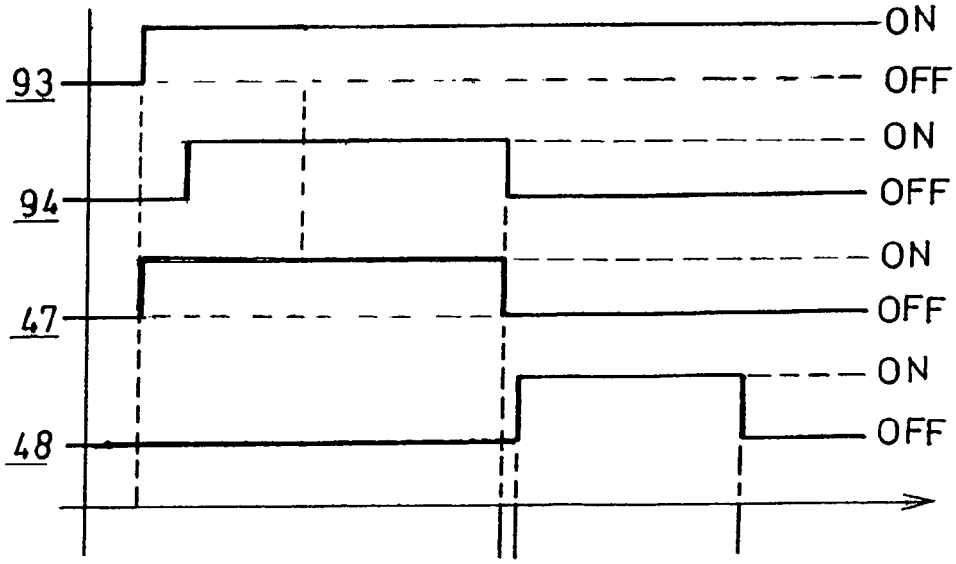
FIGURE 26

FIGURE 27
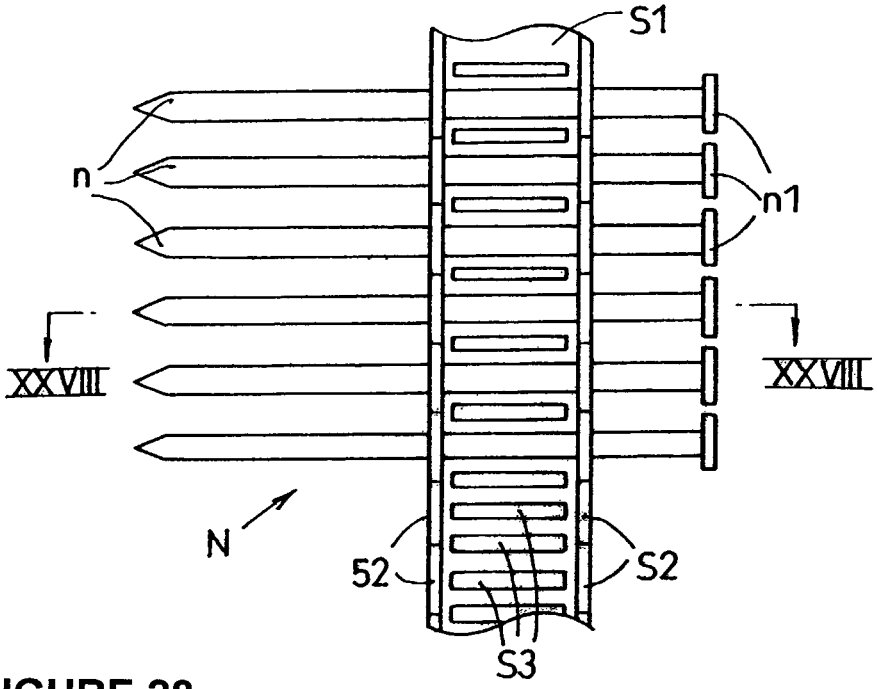
FIGURE 28
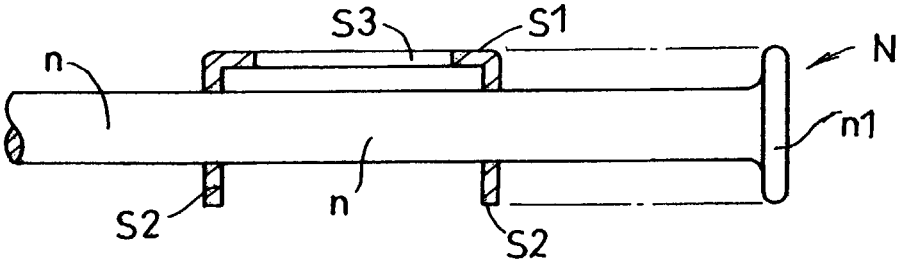
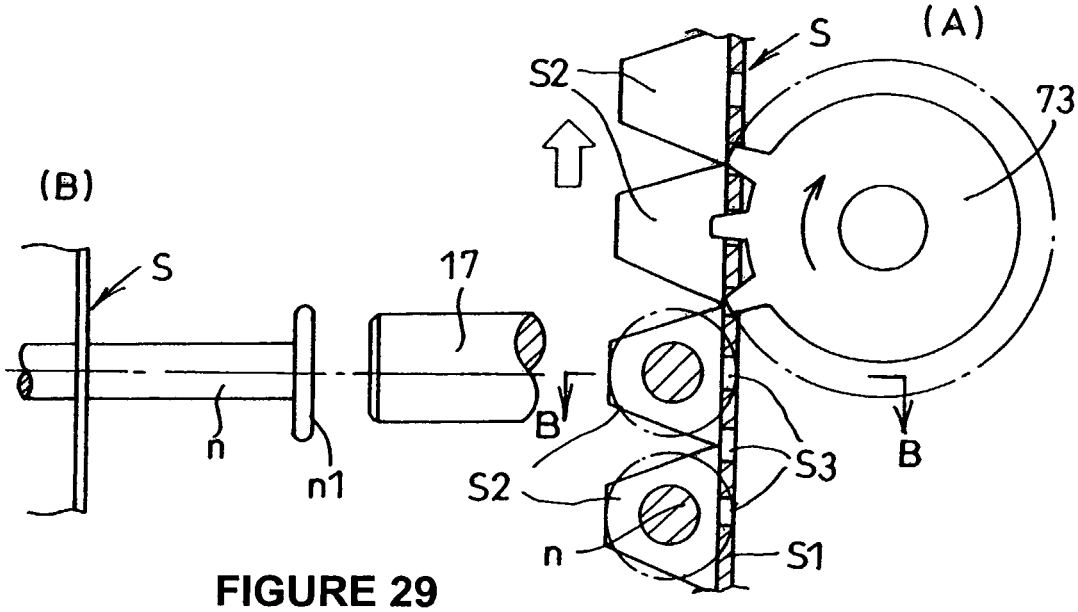
FIGURE 29

PORTABLE TYPE FASTENER DRIVING TOOL

RELATED APPLICATIONS

The present application is a National Phase entry of International Application Number PCT/IB2005/000823, filed Mar. 30, 2005, which claims priority from, Japanese Application Number 2004-105992, filed Mar. 31, 2004, the disclosure of which is hereby incorporated by reference herein in its entirety.

TECHNICAL FIELD

The present invention relates to a portable type fastener driving tool which is used to drive fasteners such as nails and pins into a workpiece by hammering them in the axial direction.

BACKGROUND

Portable type fastener driving tools can be classified as nail driving devices, pin driving devices (or tack driving devices) and staple driving devices and the like on the basis of the type of fastener which is being driven. On the other hand, they can be classified as devices using compressed air, the pressure of combustion, the brisance of gunpowder and electricity and the like on the basis of the driving source.

In any case, fastener driving tools are provided with rods which are used for driving and continuous driving is permitted by supplying the fasteners one by one to the front of the rod.

A great many fasteners which are used in fastener driving tools are connected by connecting materials. The fastener connecting bodies are housed in a magazine and the fasteners are supplied one by one to the front of the rod by feeding them in one pitch increments inside the magazine.

There is a type of fastener connecting body which can be wound in a coil (rolled). These are connected so that they are parallel to one another by using a connecting material which is made of a material which can alter its shape such as resinous tape and narrow wire (such as metal wiring) so that these are often used for nails. These fastener connecting bodies which are wound to a coiled shape are advantageous in that they can be housed in a large quantity in a drum-shape magazine. Thus, the driving tools which can be used with coiled nail connecting bodies are known as "coil nailers".

Usually coil nailers are "Air tools" almost without exception which use compressed air as a drive source. On a coil nailer, a feed device must be disposed which is provided with a movable feed member which feeds the nail connecting bodies to the front of the rod. This is done because the compressed air can be used as a source of motive power with the feed device. Thus, the prior art nail feed device in coil nailers was configured so that it used compressed air to drive a small piston and a feed pawl is moved reciprocally by virtue of the piston to feed nails, as disclosed in Japanese Publication of Utility Model Application H5-72380, and U.S. Pat. No. 3,945,551.

There were problems with the structure which was used to feed nails (fasteners) using a reciprocating type feed pawl such as the feed device in the prior art coil nailers in that the movement of the members was complex so that oftentimes the feed process was not smooth and breakdowns readily occurred.

The reason of the prior art feed pawl was functioned by using a piston was because compressed air was used as a motive power source for the feed device. For example, there were problems that the prior art feed device was difficult to use with driving tools such as gas combustion driving tools and explosive type driving tools which could not use compressed air.

It is an main object of the invention in the present application to improve the present conditions.

SUMMARY

The invention indicated in Aspect 1 is in a driving tool which is provided with (a) a main body in which a rod which drives fasteners is housed; (b) a rod driving out means which forces the rod ahead in the axial direction; (c) a head part which is located on the front end of the main body and which is provided with a fastener guide part; (d) a fastener retaining means which loads fastener connecting bodies which connect a great many fasteners so that they are parallel to one another; and (e) a motive force type of feed means which loads fastener connecting bodies in the direction of connected fasteners and onto the aforementioned fastener retaining means and which supplies fasteners one by one to the front of the rod; the invention being characterized as having the aforementioned fastener feed means which is provided with a rotary type member which latches onto the fastener connecting body and feeds them.

In the invention indicated in Aspect 2, the aforementioned rod driving out means used combustion gas pressure as a motive power source, and the aforementioned fastener feed means is provided with (a) a feed gear as a rotary type of feed member and (b) an electric motor which drives this feed gear.

In the invention indicated in Aspect 3, while the aforementioned fastener connecting body was permitted to be wound in a coil shape or in a roll shape, and the aforementioned fastener retaining means is a magazine which is provided with a cover which can be opened and closed at will. This magazine is formed like a schematic circular drum when seen in cross section so that the nail connecting bodies can either be housed while they are wound in a coil shape or in a roll shape.

In the invention indicated in Aspect 4, the aforementioned feed means is provided with (a) a first sensor which is used to detect the movement of the rod; (b) a second sensor which is used to detect the feed of the fasteners; and (c) a brake which is used to stop the motor from turning. It is set so that when the first sensor detects that the rod has gone backwards, the motor is driven and the fastener feed begins. When the second sensor detects that the fastener feed is completed, the aforementioned brake is energized and the motor is stopped from turning.

According to the process of the invention in the present application, the feed member is a rotary type so that the feed mechanism can be simplified. As a result, the fastener feed can be carried out smoothly and at the same time breakdowns can be held in check.

However, since gas combustion type driving tools do not require an accessory device such as an air compressor, they have outstanding maneuverability. They also have outstanding operability since they do not require a hose and at the same time, the operator can keep any burden on him/her to a minimum. Tests have been carried out on possible use of coil shaped fasteners and on feeding coil type nail connecting bodies using part of the gas combustion pressure. However, it has not been possible to stabilize the feeding of coil shaped fasteners and they have not yet reached the practical stage.

On the other hand, in the invention in the present application, a rotary type actuator such as a motor or a rotary solenoid are capable of using electricity as a motive power source to drive the feed member. As a result, a battery can be used as a power source even for gas combustion type driving tools so that it is easy to use the coil shaped fastener mentioned in Aspect 3. As a result, the gas combustion type driving tool and the explosive combustion type driving tools can be realized in the form of a coil nailer.

Be that as it may, when the fastener driving tool is used, the fasteners must be supplied to the front of the rod after the rod has completely gone backwards. Feeding the fasteners before the rod went back or while it was going forward would lead to an accident or a malfunction.

On the other hand, when a gas combustion driving tool is used, the pulling movement of the trigger is detected by an electrical switch, the ignition plug is energized when this trigger switch is turned on and combustion (an explosion) of gas occurs. (However, it should be noted that if the safety device is not operated, the trigger switch cannot be pulled and the ignition plug will not be energized).

Therefore, when fasteners are fed using an electrical actuator, using the signals from the trigger switch is one way of detecting the rods when they move backward. This means that the time from when the trigger switch is turned on, and the rod moves forward and the regression is complete can be found out beforehand. So combining the signal from the trigger switch and a timer or a circuit for retardation, it could be a control method in which the backward movement of the rods is detected and then the electrical actuator is operated to feed the fasteners.

However, there are problems when this method is used in that when the rod stops due to some type of trouble while they are going backwards, the fasteners can no longer be fed and the electrical actuator may be damaged (burned-out). In addition, in the prior art, the rod could move forward even if the fasteners were not supplied to the front of the rod so that it was impossible to prevent "driving into the air" wherein only the rods went forward.

On the other hand, when the configuration indicated in Aspect 4 is used, the backward movement of the rod can be reliably detected so that feeding errors can be prevented. At the same time, "driving into the air" wherein only the rod moves forward can be prevented and the motor can be prevented from rotating excessively which makes it particularly suitable. Further, the first sensor and the second sensor be used with a contact type sensor and/or a non-contact-type sensor, however, the contact type sensor is preferable since it is able to prevent malfunctions.

BRIEF DESCRIPTION OF THE DRAWINGS

FIG. 1 (B) is a partial inclined view of the nail connecting body.

FIG. 7 (B) is a sectional view of (A) seen along B-B.

FIG. 13 is a sectional view of FIG. 5 and FIG. 7 (A) seen along XIII-XIII.

FIG. 14 (A) is a diagram showing the subguide body when it is slightly open from the position indicated in FIG. 13.

FIG. 14 (B) is a sectional view of FIG. 14 (A) seen along B-B.

FIG. 19 is a sectional view of FIG. 5 and FIG. 21 seen along XIX-XIX.

FIG. 20 is an exploded inclined view which explains the state in FIG. 19.

FIG. 21 is a right lateral view of the upper part of the head part.

FIG. 22 is a sectional view of FIG. 21 seen along XXII-XXII.

FIG. 23 is a sectional view of FIG. 12 and FIG. 13 seen along XXIII-XXIII.

FIG. 24 is a sectional view of FIG. 12 and FIG. 13 seen along XXIV-XXIV.

FIG. 25 is a block diagram indicating the relationships in the electrical system.

FIG. 26 is an explanatory control diagram indicating the relationship between the motor, the brake and the sensors.

FIG. 27 is a partial lateral view of the nail connecting body in the second mode of carrying out the present invention.

FIG. 28 is a sectional view of FIG. 27 seen along XXVIII-XXVIII.

FIG. 29 (A) is a schematic view showing the nail connecting bodies when they are fed.

FIG. 29 (B) is a diagram of FIG. 29 (A) seen along B-B.

DETAILED DESCRIPTION (1) Overview

Figure 1:
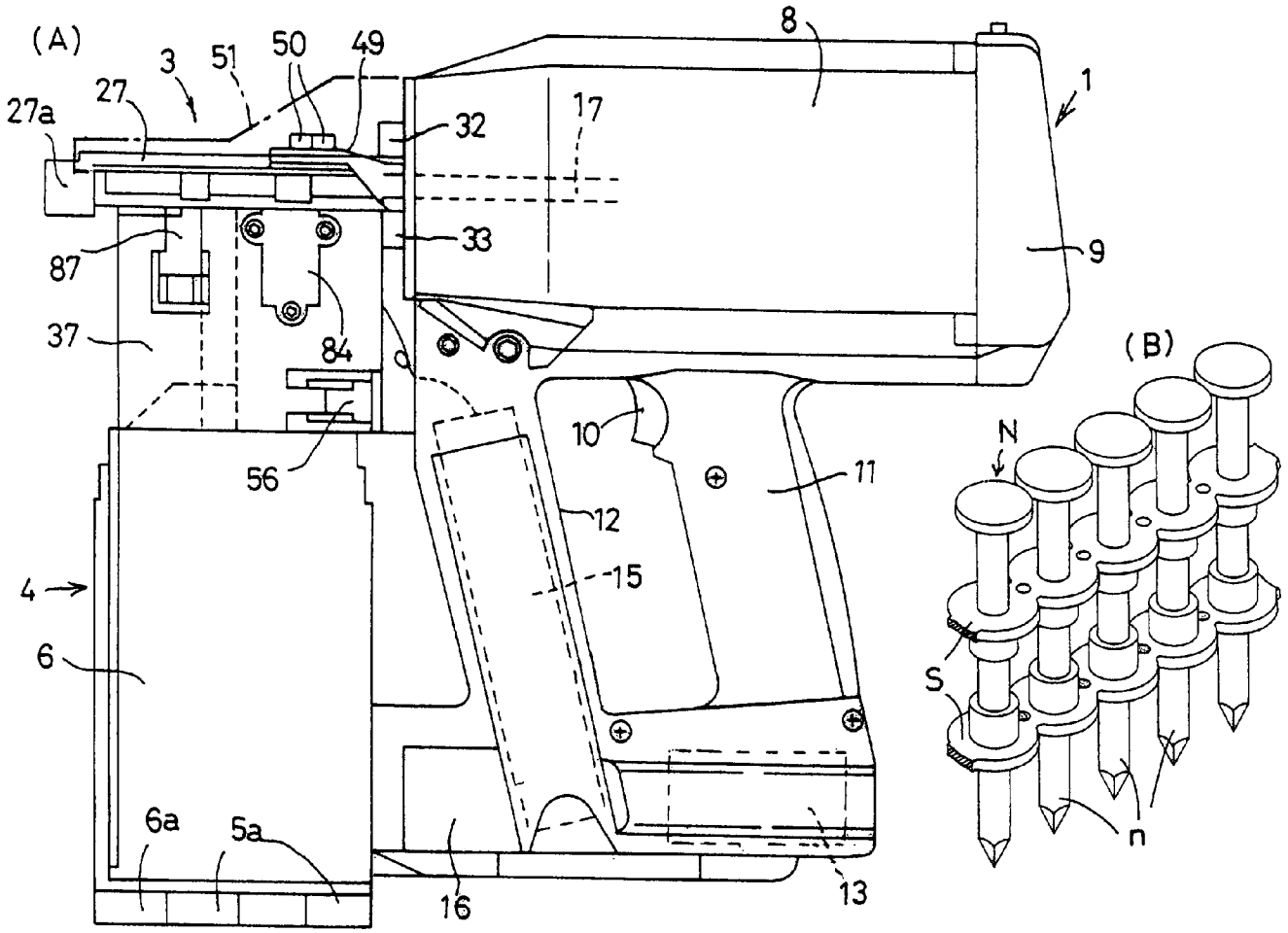
FIG. 1 (A) is a right lateral view of a gas combustion type nail driving device.
Figure 2:
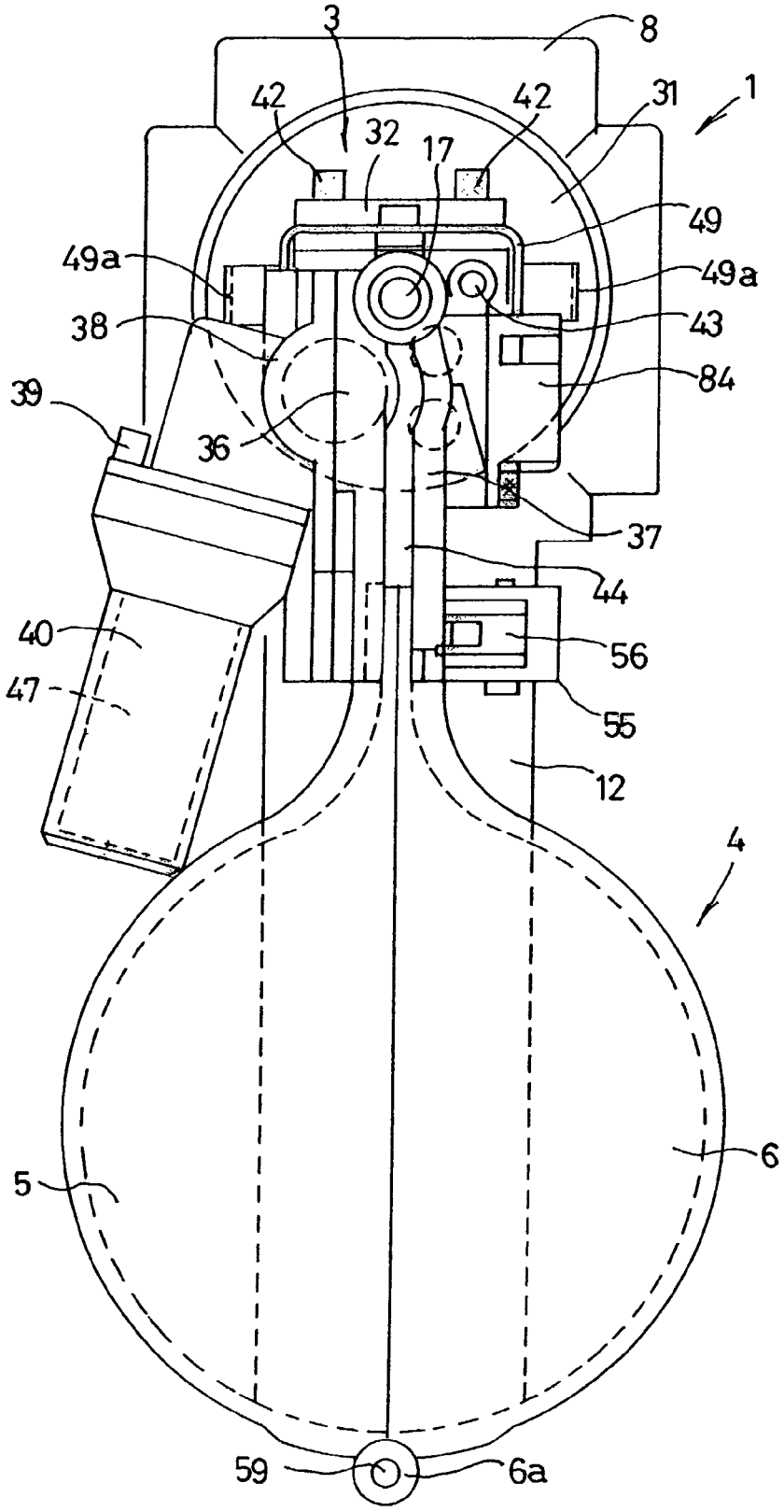
FIG. 2 is a frontal view of the nail driving device.
Figure 3:
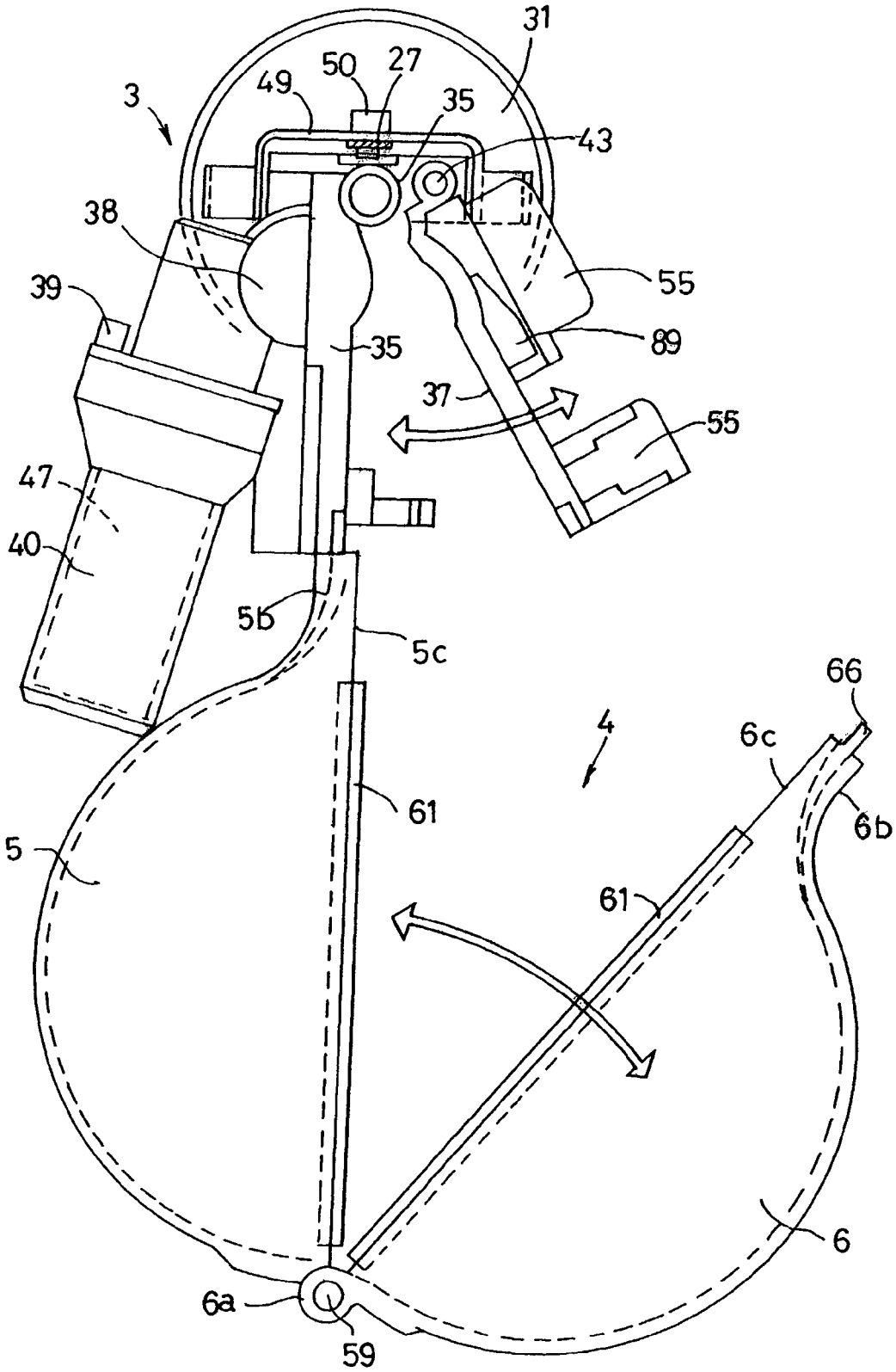
FIG. 3 is a frontal view showing the magazine when it is open.
Figure 4:
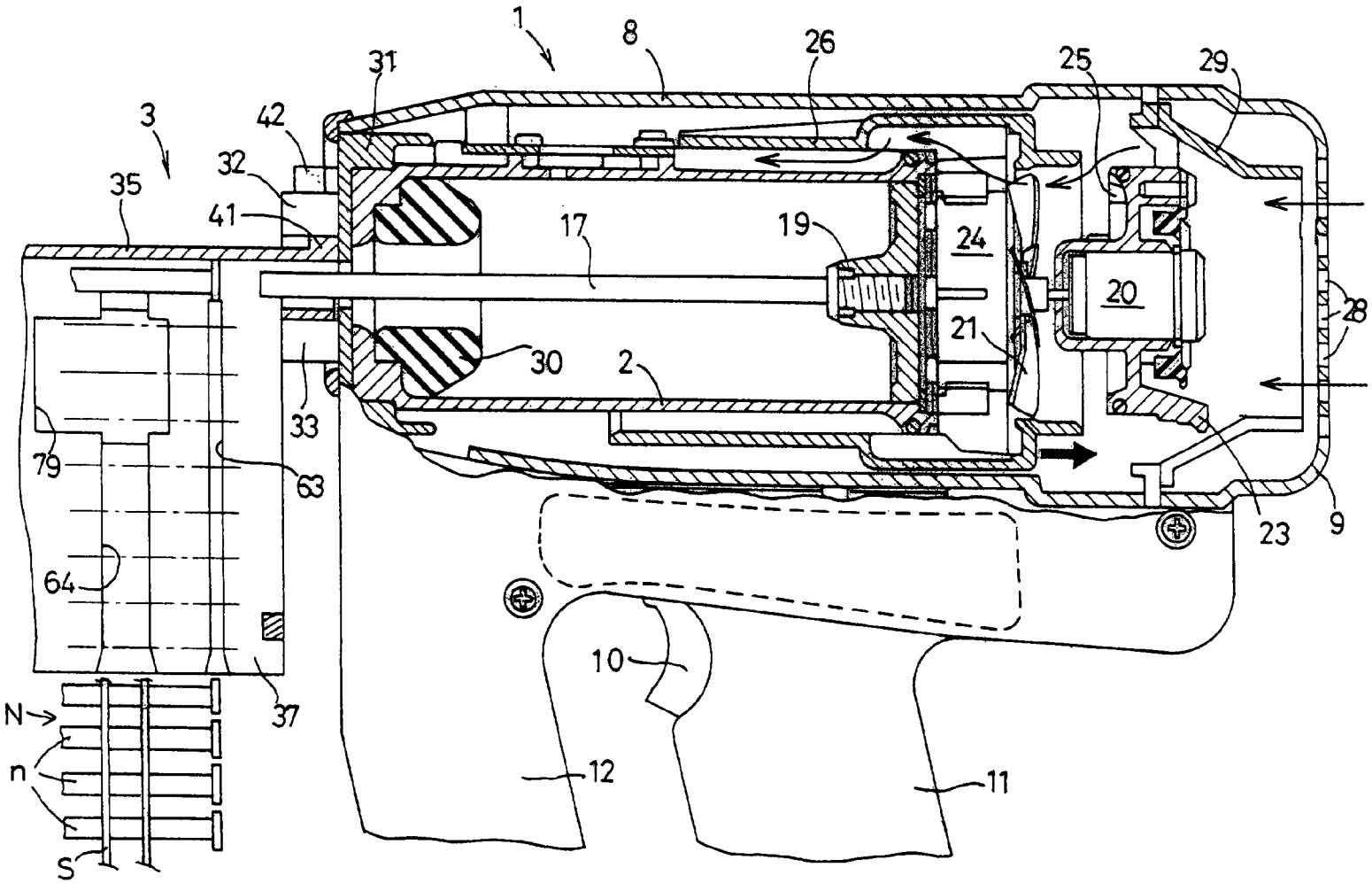
FIG. 4 is a vertical lateral view of the nail driving device.
Figure 5:
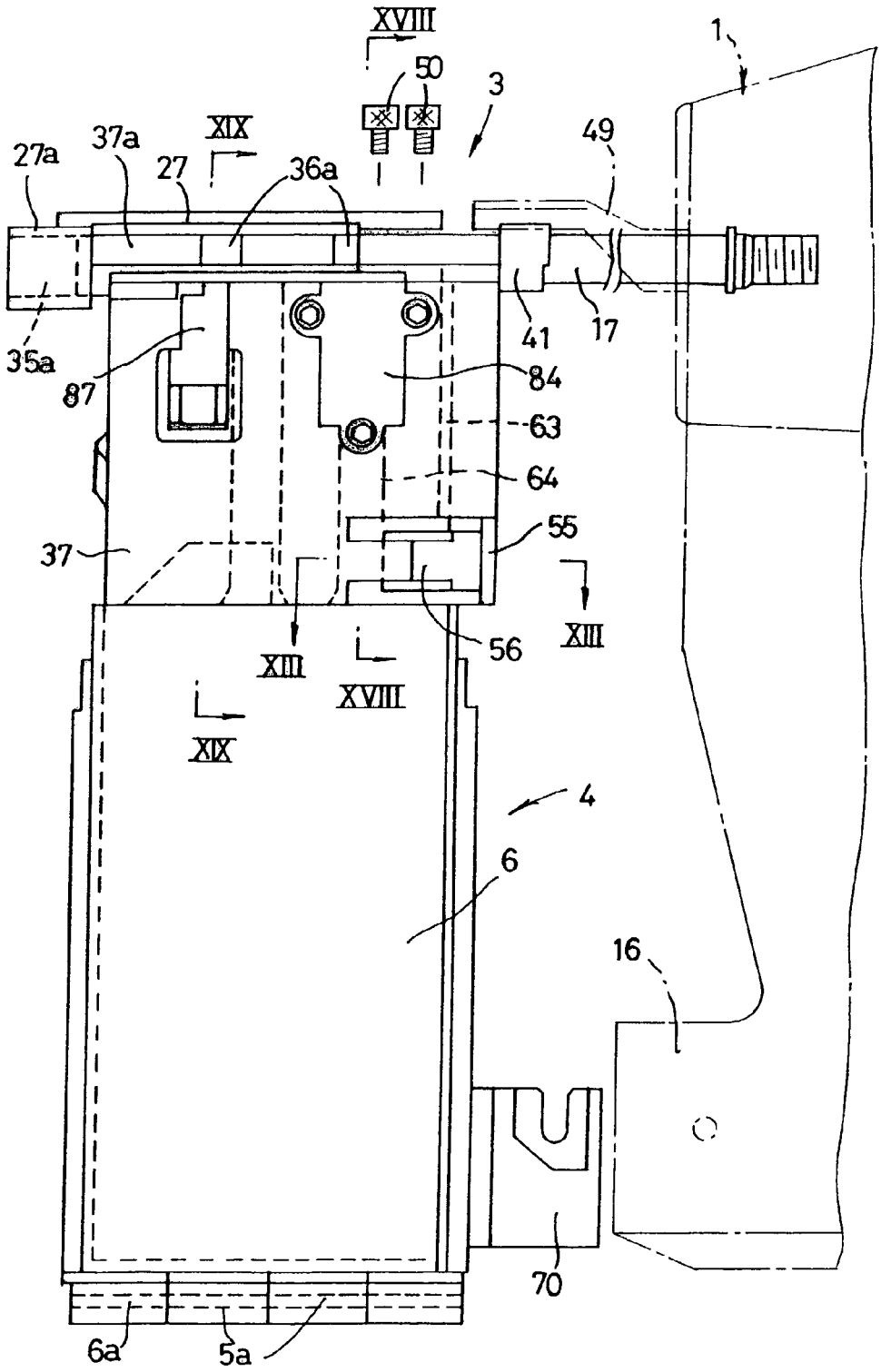
FIG. 5 is a right lateral view of the head part.

First, we shall provide an overview based on FIG. 1 through FIG. 4 and explain the basic operating structure. FIG. 1 (A) is a right lateral view of the gas combustion type nail driving device (coil nailer); FIG. 1 (B) is a partial inclined view of the nail combined body N which is used with the nail driving device. FIG. 2 is a frontal view of the nail driving device when it is in drive enable mode. FIG. 3 is a frontal view showing the magazine when it is open. FIG. 4 is a vertical lateral view of the nail driving device. FIG. 5 is a right lateral view of the head part.

As can be seen from FIG. 1 and FIG. 4, the nail driving device is provided with (a) a main body (body) 1 which houses a cylinder 2; (b) a head part 3 which is disposed on the front surface of the main body 1; and (c) a magazine 4 which is attached to the head part 3 so that it can be attached and detached.

As indicated in FIG. 1 (B), the nail connecting body N is shaped so that it connects multiple nails n which are arranged on two resinous connecting bodies (strips) S and this nail connecting body N is housed in the magazine 4 by winding in a coil shape (further, in the explanation given from this point forward, when it is not necessary to distinguish between a single body nail and a connecting body, the term "nail n" is sometimes used).

As indicated in FIG. 3, the magazine 4 is made up of (a) a fixed member 5 which is attached to the head part 3; and (b) a movable member (cover) 6 which is connected to the bottom end of this fixed member 5 by a pin 59 so that it can be opened and closed at will.

The main body 1 is provided with (a) a main housing 8 which is hollow and which is used to configure the shape of the main body 1; and (b) a rear cover 9 which is anchored to the rear surface of the main housing 8 by a screw. (c) A grip (handle) 11 which is hollow and which is provided with a trigger 10 on the top end and (d) a front part 12 which is positioned so that it slants forward when seen from the side and positioned at the front of the grip 11. 11 & 12 are disposed on the bottom surface part of the main housing 8 so that they extend downward.

A fuel cell chamber with an opening which faces downward and which is closed by a cap is located on the front part 12. A gas cartridge (gas cylinder) 15 is housed in this fuel cell chamber. The gas cartridge 15 can be inserted and removed by opening and closing the cap. There is an open space on the bottom of the grip 11 and a charging-type battery 13 is housed in this open space.

Further, the grip 11 is hollow and a circuit unit (not shown in figure) which controls the driving operations is disposed inside this. The front part 12 and the lower end of the grip 11 are connected so that they form an integral piece. A support bracket part 16 which retains the magazine so that it does not fall is disposed on the front of the bottom end of the front part 12 so that it protrudes.

As can be seen from FIG. 4, the nail connecting bodies N which are housed in the magazine 4 are fed to the head part 3 in one pitch increments and the nail n is moved forward by the impact of the rod 17 and is driven into the workpiece.

(2) Basic Structure and Operations

Next, we shall provide a simple explanation of the basic structure of the nail driving device based on FIG. 4. A piston 19 is inserted inside the cylinder 2 so that it can slide at will. A rod 17 (could be called a driver blade or a hammer blade) is attached to this piston 19. In this mode of carrying out the present invention, the rod 17 is attached to the piston 19 by a screw-in. The rod 17 can also be made so that it forms an integral structure with the piston 19.

Further, when a structure and indicated direction are specified in the Specification by wording such as "up and down", "left and right" and "front and backward", "left and right" is based on the point of view facing the user (seeing from the direction to which the rod moves forward, to the direction opposite that). "Front and backward" is based on the direction in which the rod 17 either moves forward or backward. "Up and down" is based on the state wherein the user maintains the nail driving device at a position where the rod 17 is horizontal. As a result, the head part 3 is disposed at the front of the main body 1 and the magazine 4 is disposed at the bottom of the head part 3.

The fan 21 which is driven by the fan motor 20 is disposed at the rear of the cylinder 2. The fan motor 20 is fixed to the cylinder head 23. The space between the rear end of the cylinder 2 and the cylinder head 23 is combustion chamber 24.

As a result, the fan 21 is disposed inside the combustion chamber 24. The fan 21 is used mainly for stirring together the combustion gas and the air, for scavenging the combustion gas and for cooling the member which encompasses the combustion chamber 24. An ignition plug 25 which overlooks the combustion chamber is disposed on the cylinder head 23. Further, the cylinder 2 may be designed to make into the combustion chamber 24.

The schematic rear half of the cylinder 2 is hollow and is surrounded by the valve sleeve 26 which can move back and forth in the axial direction of the rod 17. The valve sleeve 26 forms a part of the safety device so that the rear part diameter is larger than the front part diameter. Then, when the nose member 27 (to be discussed in detail later on) makes contact with the workpiece, the valve sleeve 26 moves backward whereupon the rear part of the valve sleeve 26 fits together perfectly with the cylinder head 23. At the same time, the front part of the valve sleeve 26 where the diameter is smaller fits together perfectly with the periphery of the cylinder 2. Accordingly, the combustion chamber 24 is sealed and at the same time that the lock of the trigger 10 is released and the trigger 10 becomes enable to be pulled, it goes to a state the ignition plug 25 could be energized.

The combustion gas which fills the gas cartridge 15 is supplied to the combustion chamber via a dosing nozzle (not shown in figure) and a control valve. An intake opening 28 is also located on the rear cover 9 in order to mix the air with the combustion gas and the rear part of the cylinder head 23 are surrounded by the guide member 29 so that the air can flow suitably into the combustion chamber 24. An interval is also located between the guide member 29 and the sleeve 26. An aperture which opens to the front is located between the main housing 8 and the cylinder 2.

When the valve sleeve 26 is in an advanced state, the trigger 10 cannot be pulled. Meanwhile, when the valve sleeve 26 goes backward and the trigger 10 is pulled, the fan 21 turns and the combustion gas inside the combustion chamber 24 and the air are stirred and at the same time, the ignition plug 25 is energized, the mixed gas is ignited and the gas burns (explodes). As a result, the piston 19 and the rod 17 go forward and the nail is driven out. A buffer member 30 which is used to absorb the shock from the piston 19 is disposed on the front end part of the cylinder 2.

An auxiliary front surface member 31 which makes up the front surface of the main body 1 is anchored to the front end surface (front end) of the cylinder 2 by screws (not shown in figure). A protruding part 32 which is disposed in the position on the top and on the bottom of the rod 17 is formed on the front surface member 31 and the head part 3 is fixed onto this protruding part 32 (the head part 3 may be fixed directly to the front surface of the cylinder 2 or the front surface of the main housing 8). Next, we shall describe the head part 3 and the magazine 4 by referring to the figures in FIG. 6 following figures.

(3). Head Part and Magazine

Figure 6:
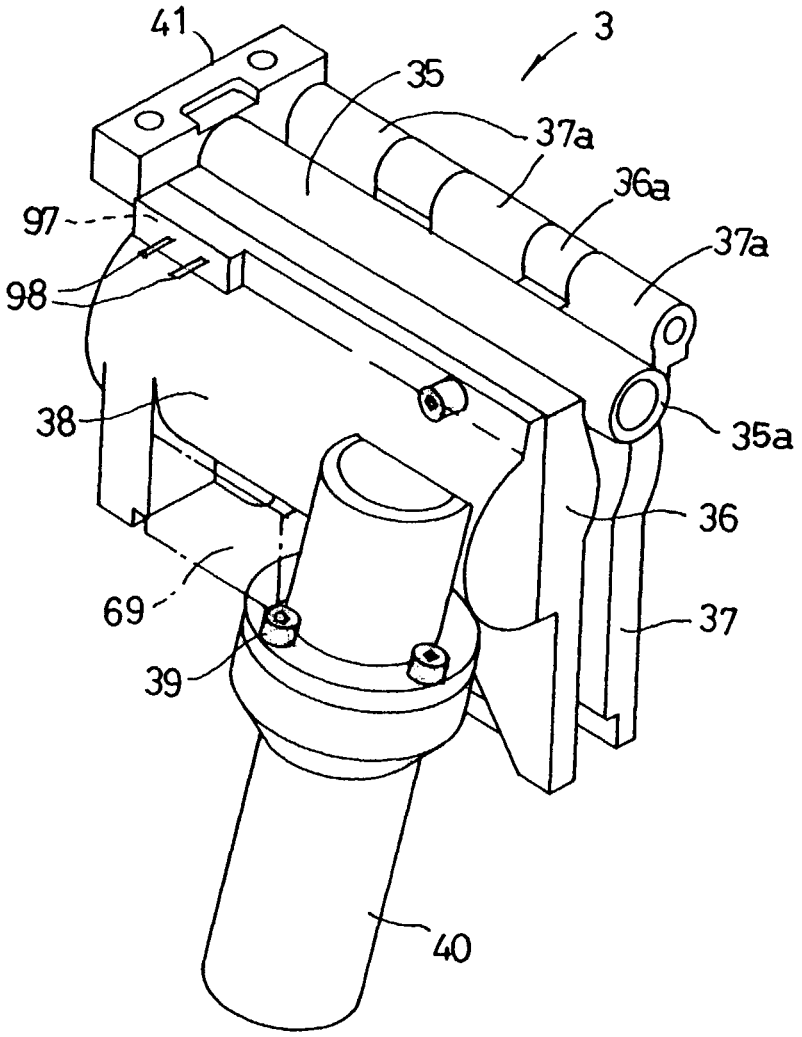
FIG. 6 is an inclined view of head part when seen from the front, from the left, at an incline.
Figure 7:
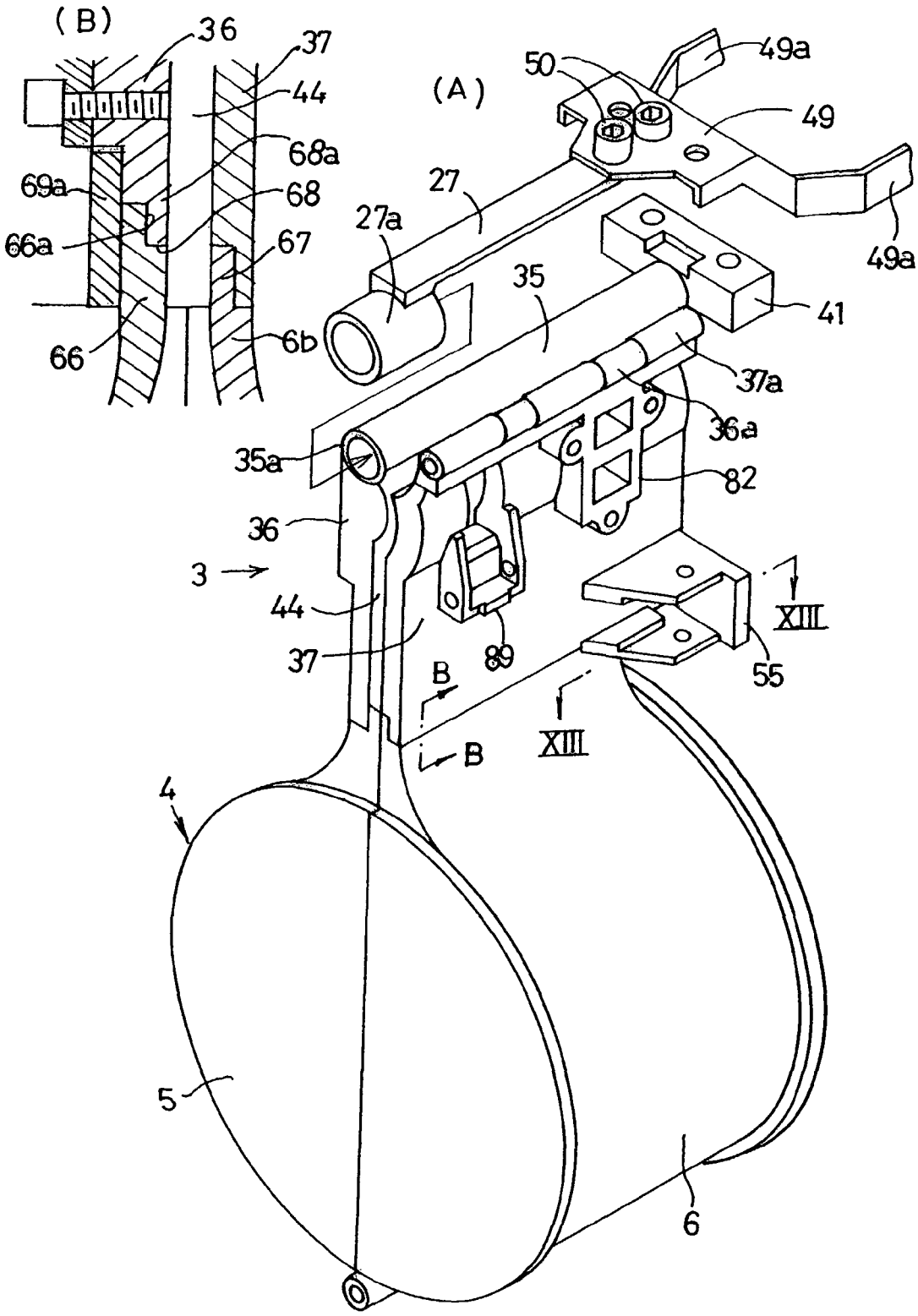
FIG. 7 (A) is a partial exploded inclined view of the head part.
Figure 8:
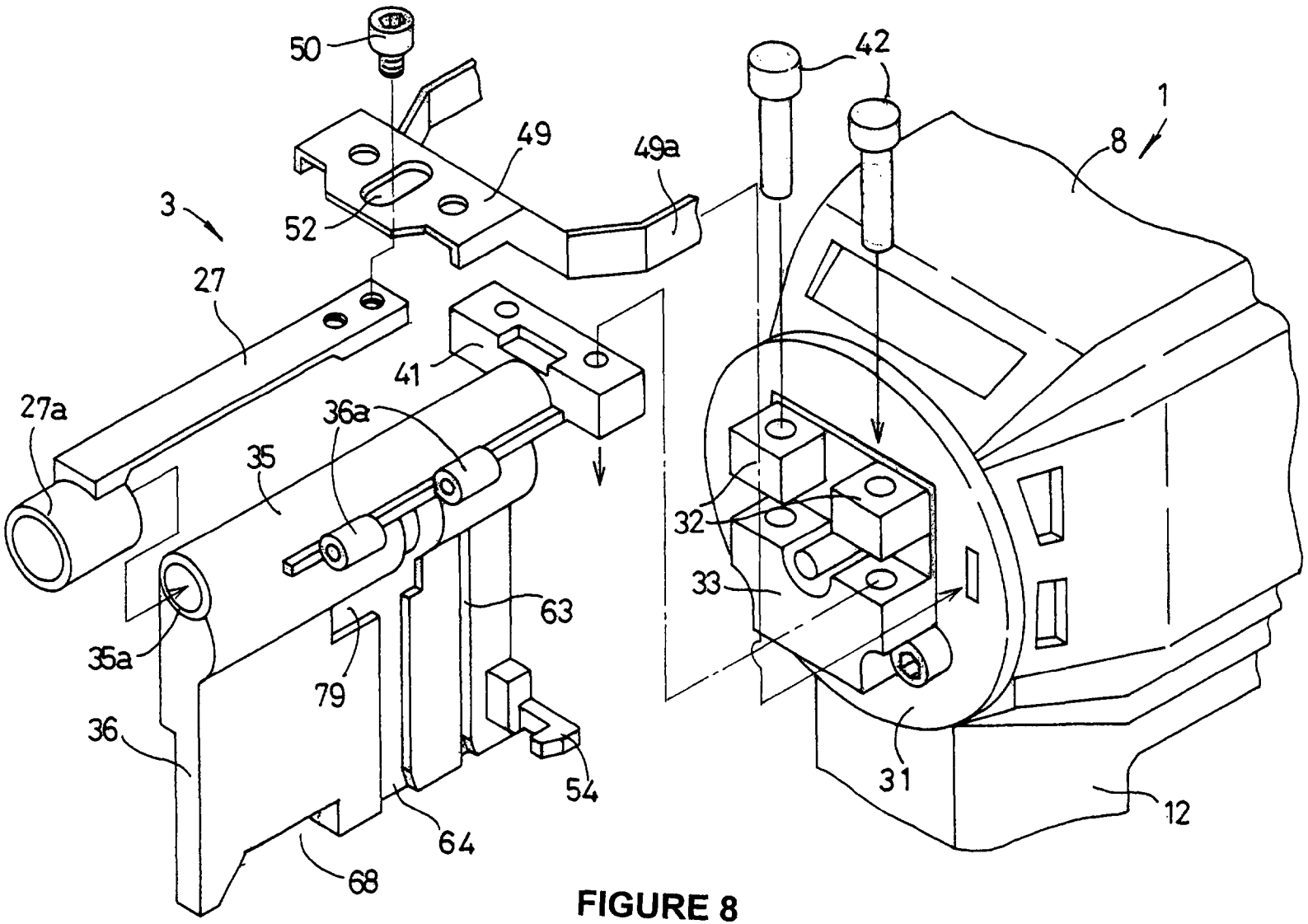
FIG. 8 is an exploded inclined view of the head part and the main body.
Figure 9:
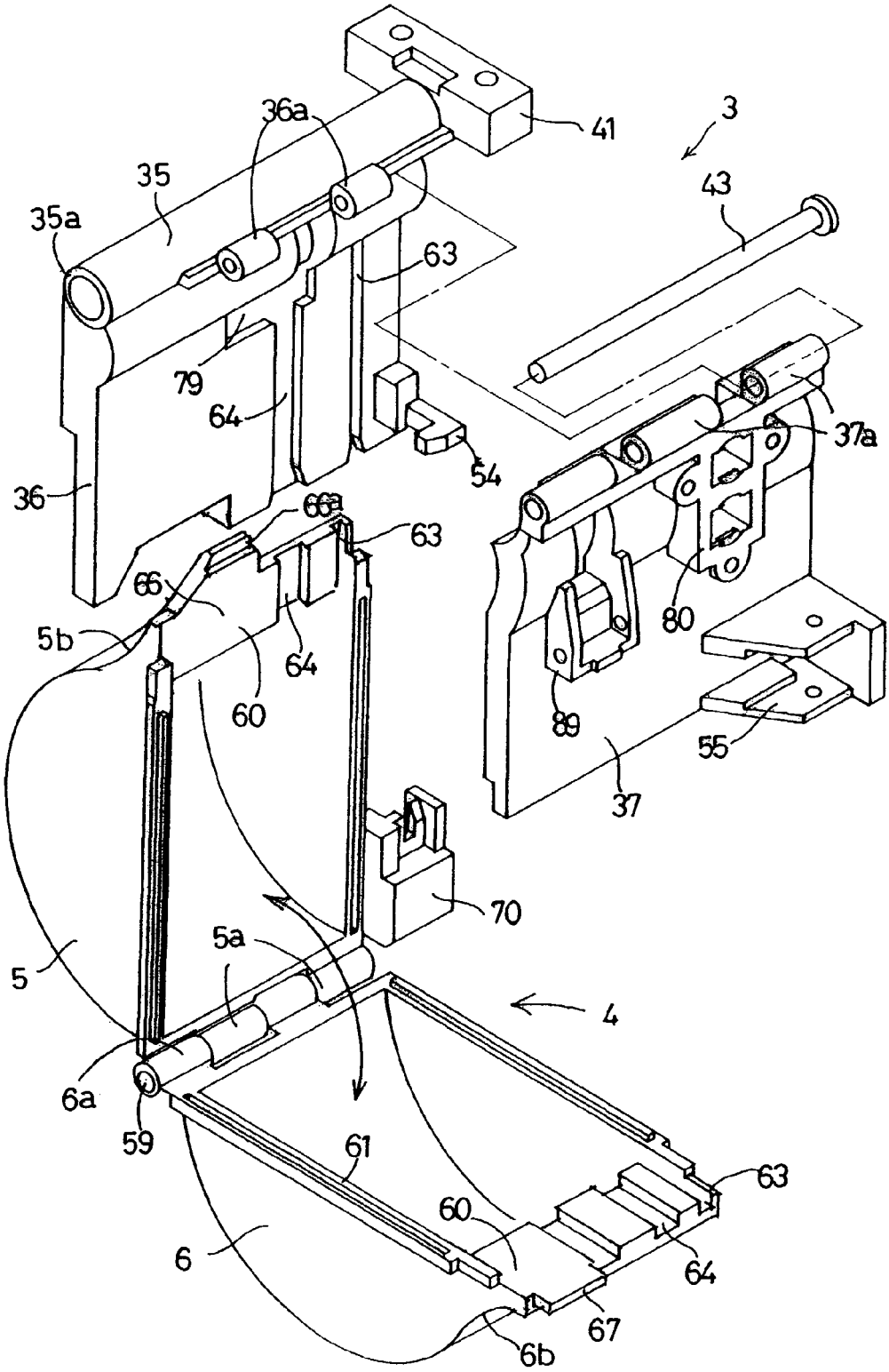
FIG. 9 is an exploded inclined view of the head part and the magazine.
Figure 10:
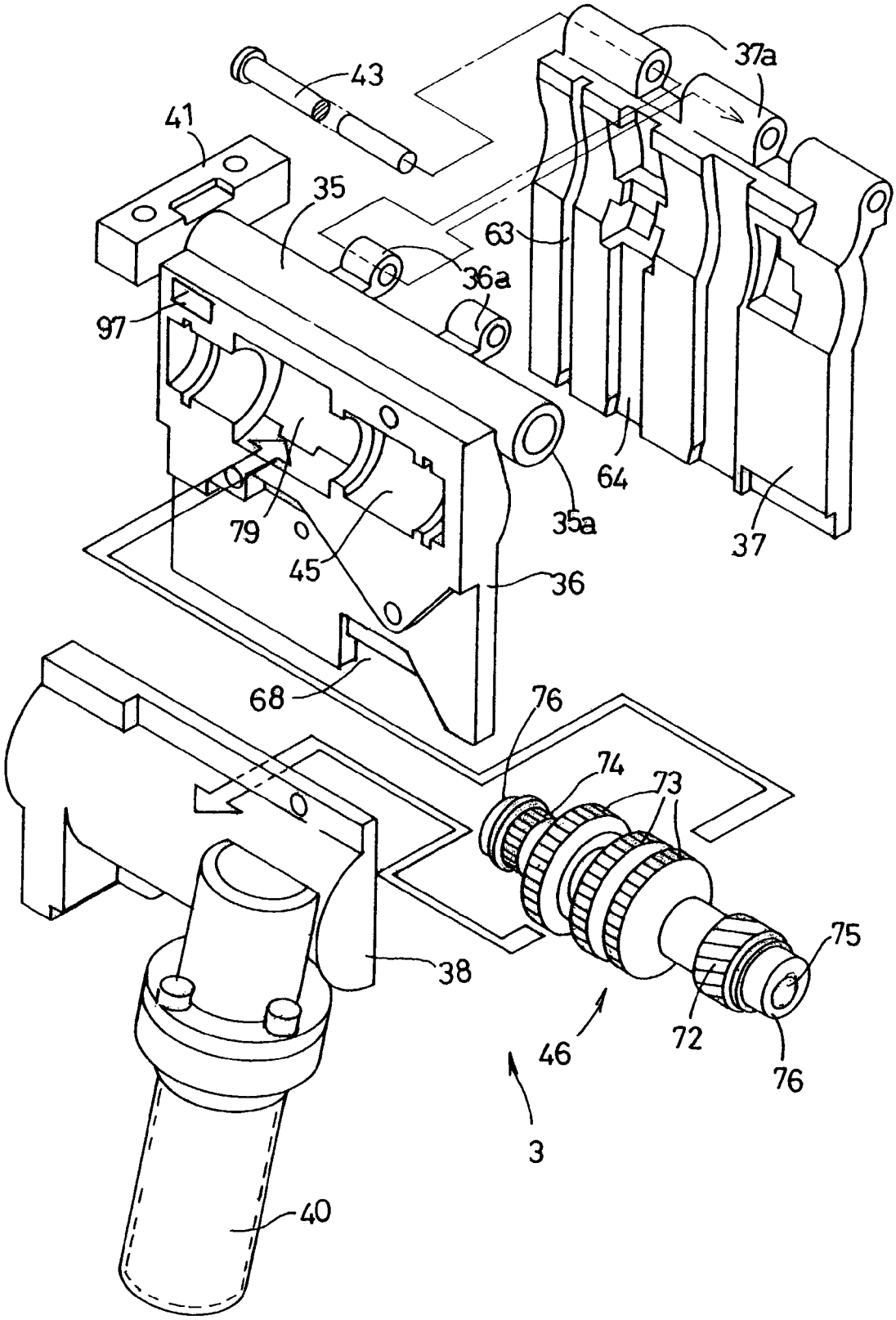
FIG. 10 is an exploded inclined view of the head part.
Figure 11:
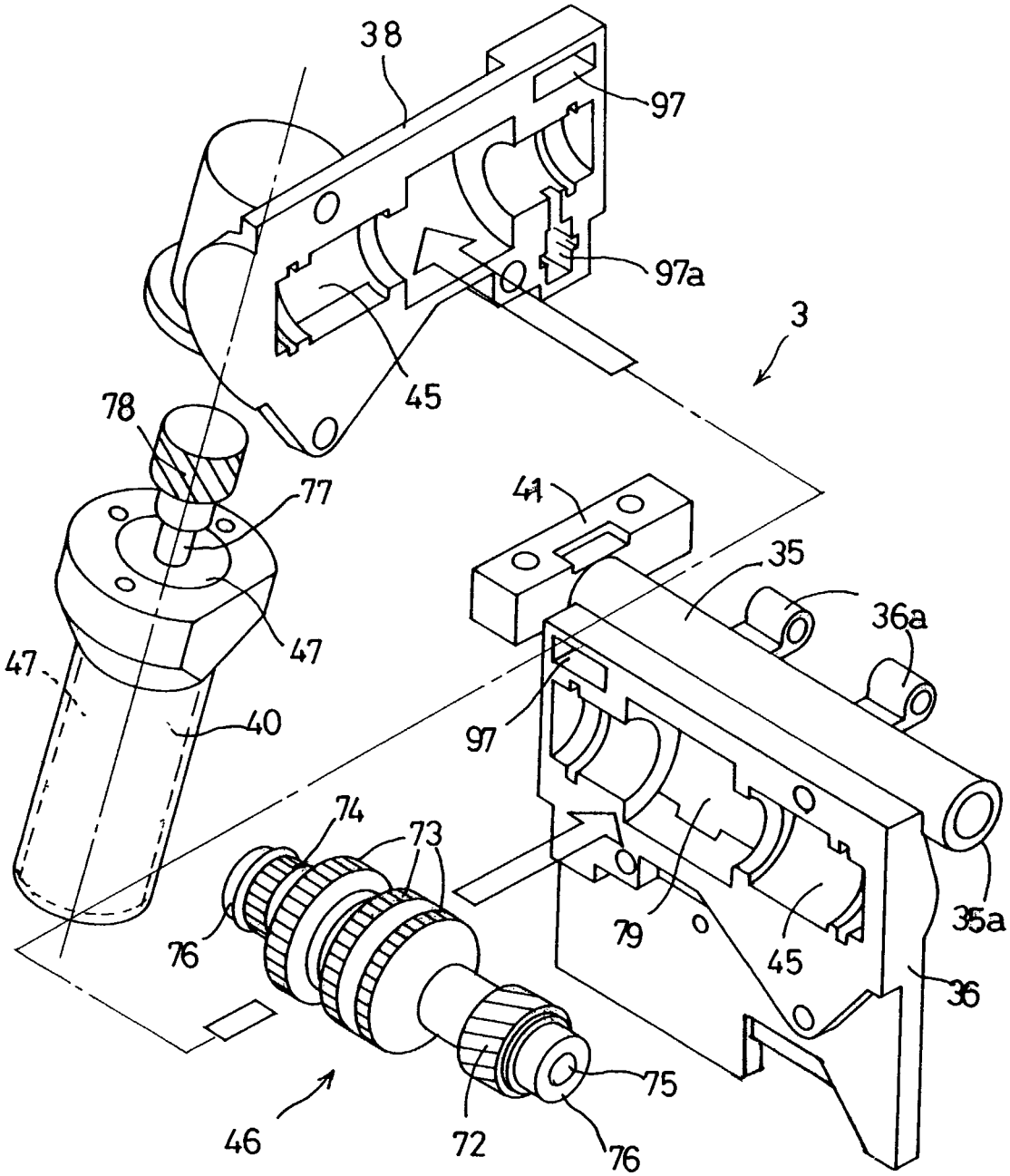
FIG. 11 is an exploded inclined view of the head part.
Figure 12:
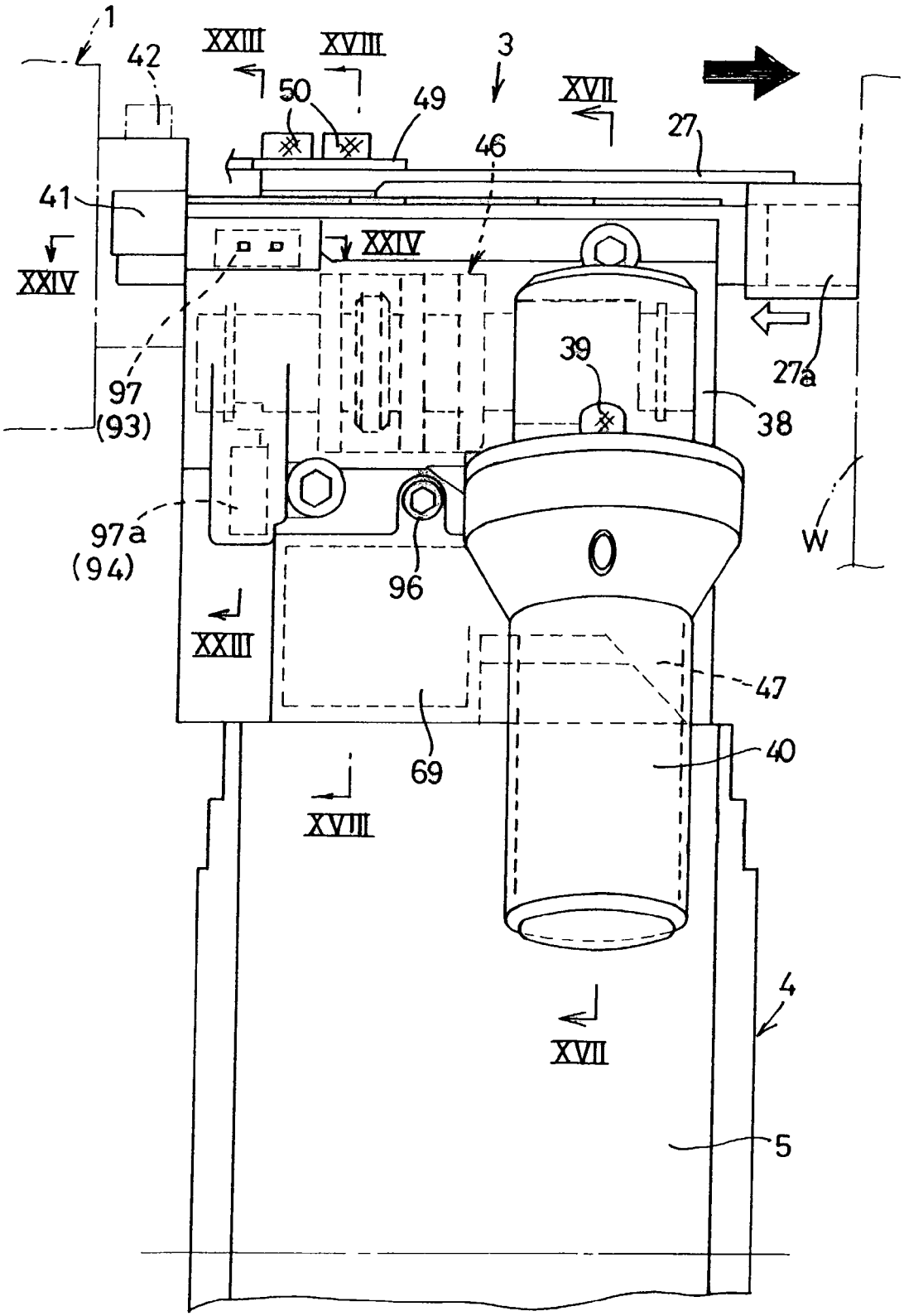
FIG. 12 is a left lateral view of the head part.

FIG. 6 is an inclined view of the head part 3 overlooked from the front and left side. FIG. 7 (A) is a partial exploded inclined view of the head part 3 when attached to the magazine 4 overlooked from the front and right side. FIG. 7 (B) is a sectional view along B-B in FIG. 7 (A). FIG. 8 is an exploded inclined view of the head part 3 and the main body part 1. FIG. 9 is an exploded inclined view of the head part 3 and the magazine 4. FIG. 10 and FIG. 11 are exploded inclined views of the main members which make up the head part 3. FIG. 12 is a left lateral view of the head part 3.

FIG. 10 will help to provide an overall understanding of these parts. The head part 3 is provided with (a) a main guide body 36 which has a guide tube 35 which guides the forward motion of the nail n and the rod 17; (b) a subguide body 37 (which could also be called a cover member) which is shaped like a schematic plate which overlaps the right lateral side of the main guide body 36; (c) a gear cover 38 which overlaps with the left lateral surface part of the main guide body 36; and (d) a motor case 40 which is anchored to the gear cover 38 by the screws 39.

The main body part of the main guide body 36 is formed like a block plate. A guide tube 35 in the front and back in the lengthwise direction is disposed on the top end of this so that they form an integral piece. The front end part of the guide tube 35 becomes a front facing protruding part 35*a* which protrudes somewhat from the main body part of the main guide body 36. An attachment part 41 which is long on the left and right is formed on the rear end part of the main guide body 36. This attachment part 41 is fixed by pins 42 to the protrusions 32 and 33 of the front surface member 31 of the main body 1.

The hinge parts 36*a* and 37*a* are disposed on the upper end part of (a) the main guide body 36 and (b) the subguide body 37 so that they protrude. These hinge parts 36*a* and 37*a* are connected by a hinge pin 43 from front to back in the lengthwise direction. As a result, the subguide body 37 could be lifted and turned centering on the shaft 43, as indicated in FIG. 3.

When the subguide body 37 is closed, the upper part of the magazine 4 is clamped and retained between the bottom ends of the main guide body 36 and the subguide body 37. At the same time, part of the bottom of the guide tube 35 between the main guide body 36 and the subguide body 37 is formed as a nail guide space 44 in order to feed the nails n to the guide tube 35. In addition, the guide tube 35 opens downward toward the nail guide space 44. As a result, only the front part and the back part of the guide tube 35 are tube shaped.

Meanwhile, a sectional schematically semicircular gear chamber 45 is formed as a recession on the top of the left lateral surface of the main guide body 36 so that it extends to the front and to the rear. The gear unit 46 is retained by the gear chamber 45 and the gear cover 38 so that it can turn at will and cannot fall out of place. Then, the gear unit 46 turns and is driven intermittently by the feeding motor 47 which is housed in the motor case 40 so that the nail connecting body N is fed in one pitch increments.

A direct current pulse motor (step motor) may be used for the feed motor 47. Brake can be applied to the feed motor 47, for example by applying a current so that the feed motor turns inversely. A mechanical brake such as an electromagnetic brake may be used as the braking means.

The head part 3 is provided with a nose member 27 which makes up part of the safety device, as indicated in FIG. 7 (A) and in FIG. 8. The nose member 27 is formed on the top of the main guide body 36 so that it extends to the front and to the back. The front end part (front part) of the nose member forms a tube part 27*a* which is inserted on the front facing protruding part 35*a* on the guide tube 35. In addition, the rear part of the nose member 27 is fastened by bolts 50 to the intermediate interlocking member 49 which is make of a metal plate.

The intermediate interlocking member 49 is formed so that it has a two-branched forked shape when seen on a plane. The rear facing foot part 49*a* passes through the front surface member 31 of the main body 1 and extends inside the main housing 8 and is fixed to the valve sleeve 26 using a screw and the like. The intermediate interlocking member 49 is pushed in the forward direction by a spring which is not shown in the figure.

When the nose member 27 goes forward, the safety device locks and the trigger 10 cannot be pulled. As a result, this prevents "air shooting" wherein the nail n is mistakenly shot into the air.

Then, when the nose member 27 makes contact with the workpiece W, the nose member 27 moves backward relative to the head part 3 and the main body 1 so that the valve sleeve 26 goes backward and the combustion chamber 24 (see FIG. 4) is sealed. At the same time, the ignition plug 25 can be energized by pulling the trigger 10. In other words, the lock on the safety device is released with the result that the nail can be driven toward the workpiece W.

Further, when the actual product is used, a front cover 51 which covers the nose member 27 should be disposed so that the user can not operate the nose member 27 manually, as indicated by the dot-and-chain line in FIG. 1. The front cover 51 should be formed so that the opening and the closing of the subguide body 37 is not impeded and it should be fixed to the front surface of the main body 1 by screws.

As indicated in FIG. 8, the bolt insertion hole 52 on the intermediate interlocking member 49 is made long so that it extends for a long way in the front direction and the back direction. As a result, the forward and rear positions of the nose member 27 can be adjusted. The driving depth of the nail n can be adjusted by adjusting the front and rear positions of the nose member 27.

Needless to say, the structure of each of the members which make up the head part 3 may be altered if necessary. For example, the guide tube 35 may be configured separately from the main guide body 36 and both of these may also be fastened with screws and the like.

(4) Opening and Closing Structure of the Subguide Body and Closing Structure of the Magazine Next, we shall describe the opening and closing structure of the subguide body and the closing structure of the magazine referring to FIG. 13 and FIG. 14. FIG. 13 is a sectional view of FIG. 5 and of FIG. 7 (A) along XIII-XIII. FIG. 14 (A) is a diagram indicating the subguide body 37 when it is somewhat opened from the state indicated in FIG. 13. FIG. 14 (B) is a sectional view of FIG. 14 (A) along B-B.

For example, a fixed pawl 54 which protrudes towards the side of the subguide body 37 is disposed on the rear and lower part of the main guide body 36, as indicated in FIG. 9. Meanwhile, a first bracket part 55 which is formed so that it encloses the fixed pawl 54 from the top and bottom is formed on the rear and lower part of the subguide body 37. A movable pawl 56 which latches to and unlatches from the aforementioned fixed pawl 54 is attached using a pin 57 which goes in the upper and lower directions lengthwise. A collar is inserted in the pin 57.

A hooking part on the fixed pawl 54 protrudes to the front. A hooking part on the movable pawl 56 protrudes to the rear. An operating piece 56*a* is disposed on the movable pawl 56. FIG. 13 indicates both pawls 54 and 56 when they are engaged. The movable pawl 56 is pushed to a position where it engages with the fixed pawl 54 by using a twisting spring 58 which is wound around the collar. When the movable pawl 56 is unlatched from the fixed pawl 54, the subguide body 37 is pushed up and turned so that the nail connecting body N can be replaced and the inside of the heat part 3 can be inspected.

FIG. 9 is an overall view of the magazine. It is made up of a half drum-shaped fixed member 5 and a movable member 6. Both of these are connected by the hinge parts 5*a* and 6*a* which are disposed on the lower ends of them and by a pin 59 (other connecting structures may be used as well). In addition, protruding parts 5*b* and 6*b* are formed on the fixed member 5 and movable member 6 so that they are opposite the hinge parts 5*a* and 6*a*. The surface where both protruding parts 5*b* and 6*b* face each other is flat surface 60 which is used to guide the nail n.

The fixed member 5 and the movable member 6 of the magazine 4 overlap exactly at the location of the edge parts 5*c* and 6*c* extend in the radius direction. When the edge parts 5*c* and 6*c* overlap, a nail guide space 44 which makes it possible for the nail n to be moved is formed between the flat surfaces 60. As a result, there is a difference in levels of the flat surface 60 and the edge parts 5*c* and 6*c*. A pair made up of a protruding strip 61 and a grooved strip 62 is formed so that they fit together on the edge parts 5*c* and 6*c* of the fixed member 5 and the movable member 6.

A first guide groove 63 through which the head a1 of the nail n passes and a second guide groove 64 through which the connecting material S passes are formed on the opposing surfaces of the flat parts in the fixed member 5 and the movable member 6. The nail connecting body N in the mode for carrying out the present invention is connected by two connecting materials S and both connecting materials are made so that they fit into the second guide groove 64.

As can be seen from FIG. 9 through FIG. 11, the end surfaces of the protruding part in the fixed member 5 and the movable member 6 are made so that they make contact with the lower surfaces of the main guide body 36 and the subguide body 37. In addition, insertion parts 66 and 67 which fit between the main guide body 36 and the subguide body 37 are formed on the protruding parts of the fixed member 5 and the movable member 6.

The insertion part 66 of the fixed member 5 is formed so that it has a schematic angular shape when seen from the side. And a groove 68 as an angular opening when seen from the side, which faces downward toward the insertion part 66 is formed on the main guide body 36. This makes it possible for the magazine 4 to be retained so that it can neither move forward nor to the rear.

In addition, a step part 66*a* which opens toward the movable member 6 is formed on the upper end of the protruding part 66 of the fixed member 5 as seen in FIG. 7(B). Meanwhile, a thin part 68*a* which fits into the aforementioned step part 66*a* is formed on the main guide body 36. This makes it possible to prevent the fixed member 5 from being displaced in the direction of the movable member 6.

The fitting part 66 of the magazine 5 is interposed between the lower ends of the main guide body 36 and the subguide body 37 so that an interval can be maintained between the main guide body 36 and the subguide body 37 and a nail guide space 44 can be formed. In other words, the magazine 5 function as a spacer to form the nail guide space 44.

In addition, the protruding part 66 of the fixed member 5 is fixed by pressed on the main guide body 36 using the extension part 69*a* of the control circuit protection cover 69 (to be described later on). As a result, the fixed member 5 is retained so that it cannot be displaced in any direction, either to the front or to the back or to the left or to the right. In addition, as seen in FIG. 9, a latching part 70 which fits into the support bracket part 16 of the main body 1 so that it cannot fall is formed on the rear and lower end part of the fixed member 5.

(5) Nail Feed Mechanism

Figure 15:
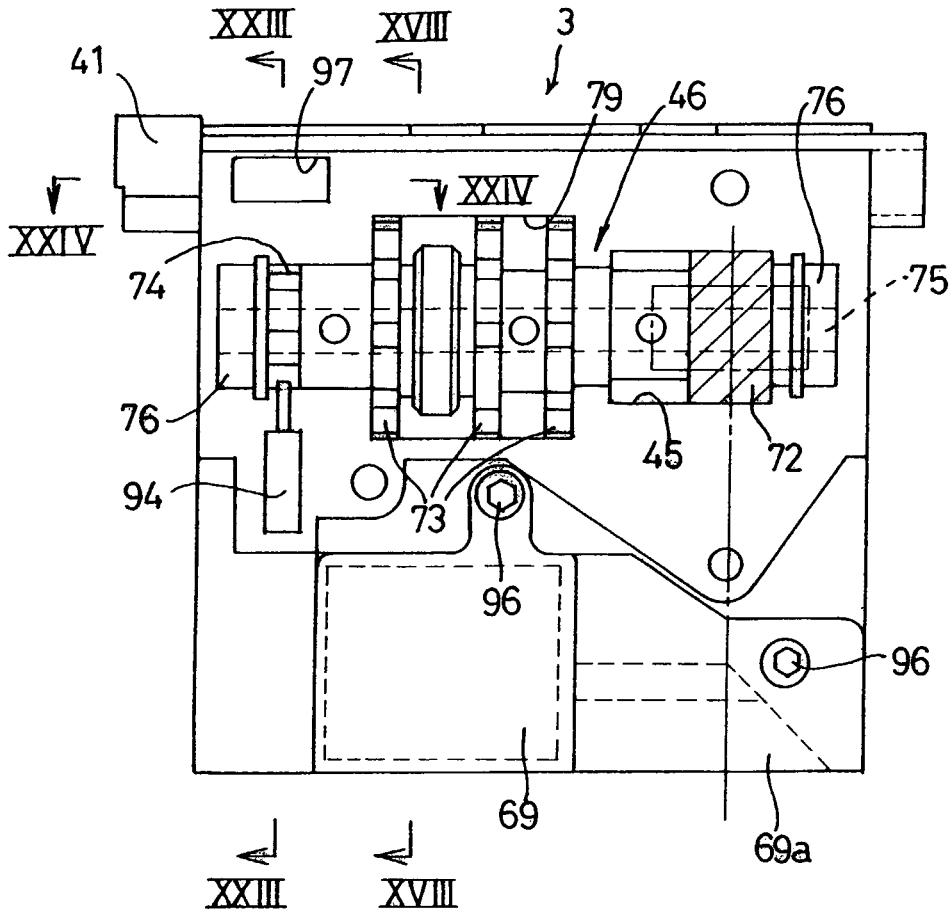
FIG. 15 is a left lateral view of the main guide body when the gear unit is attached.
Figure 16:
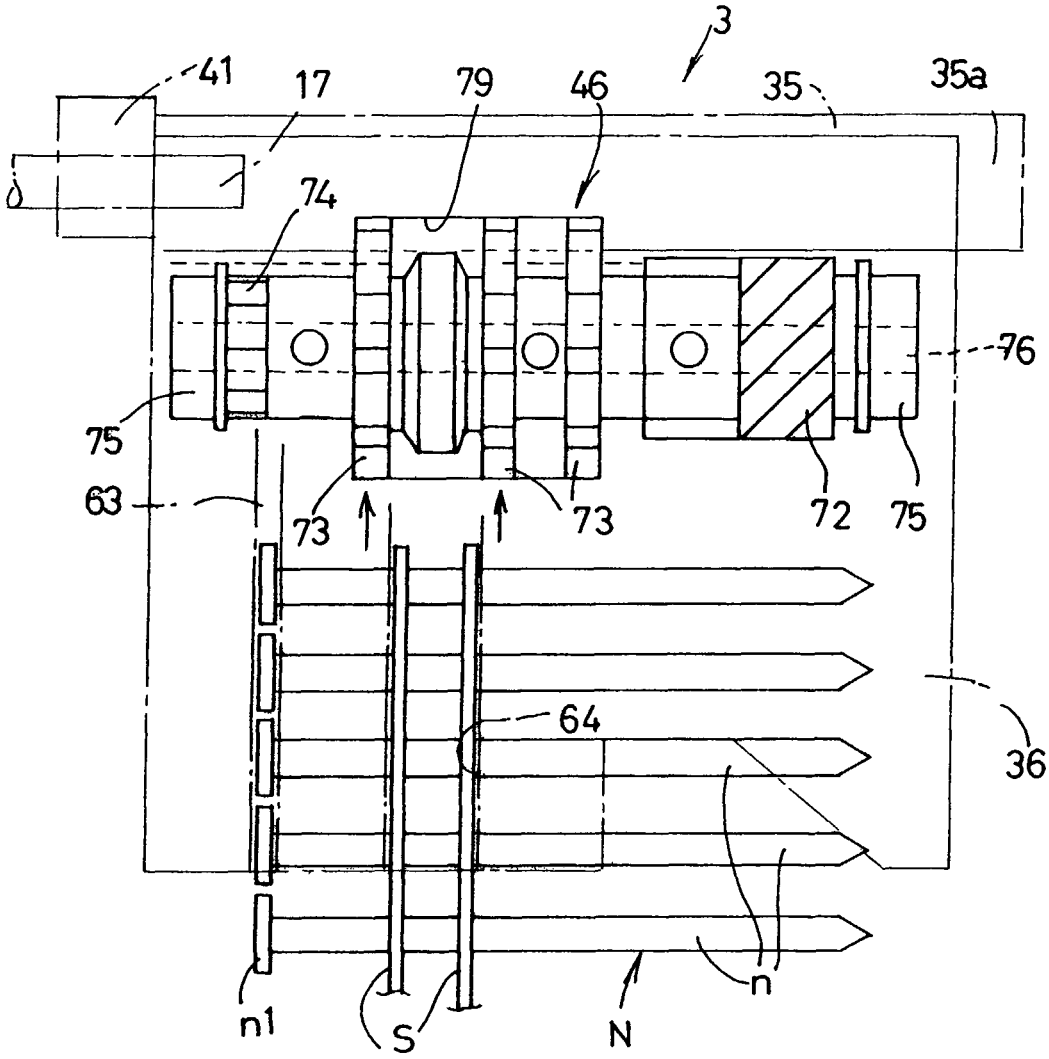
FIG. 16 is a left lateral view indicating the relation of the position of the gear unit and the nail connecting body.
Figure 17:
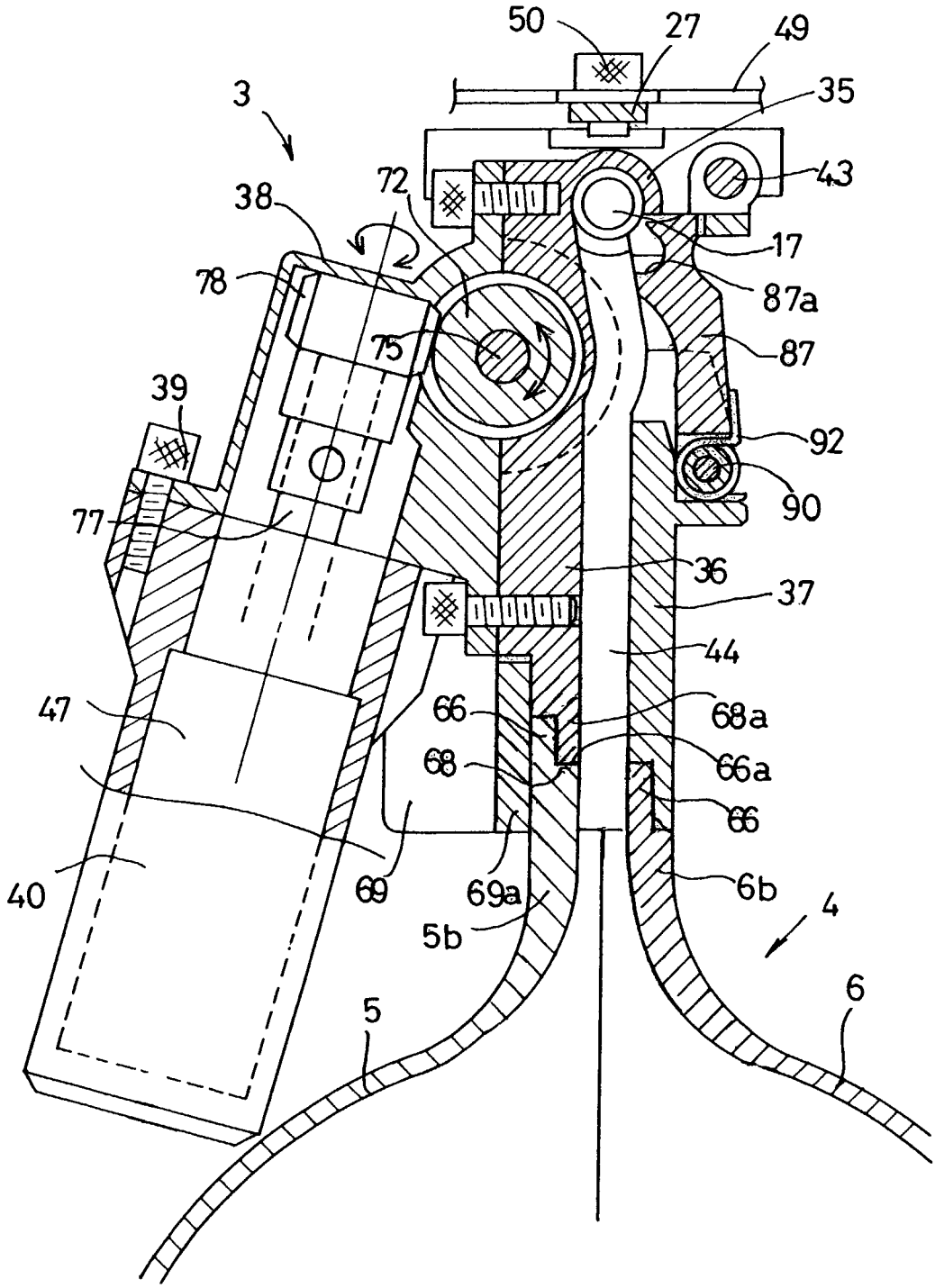
FIG. 17 is a sectional view of FIG. 12 seen along XVII-XVII.
Figure 18:
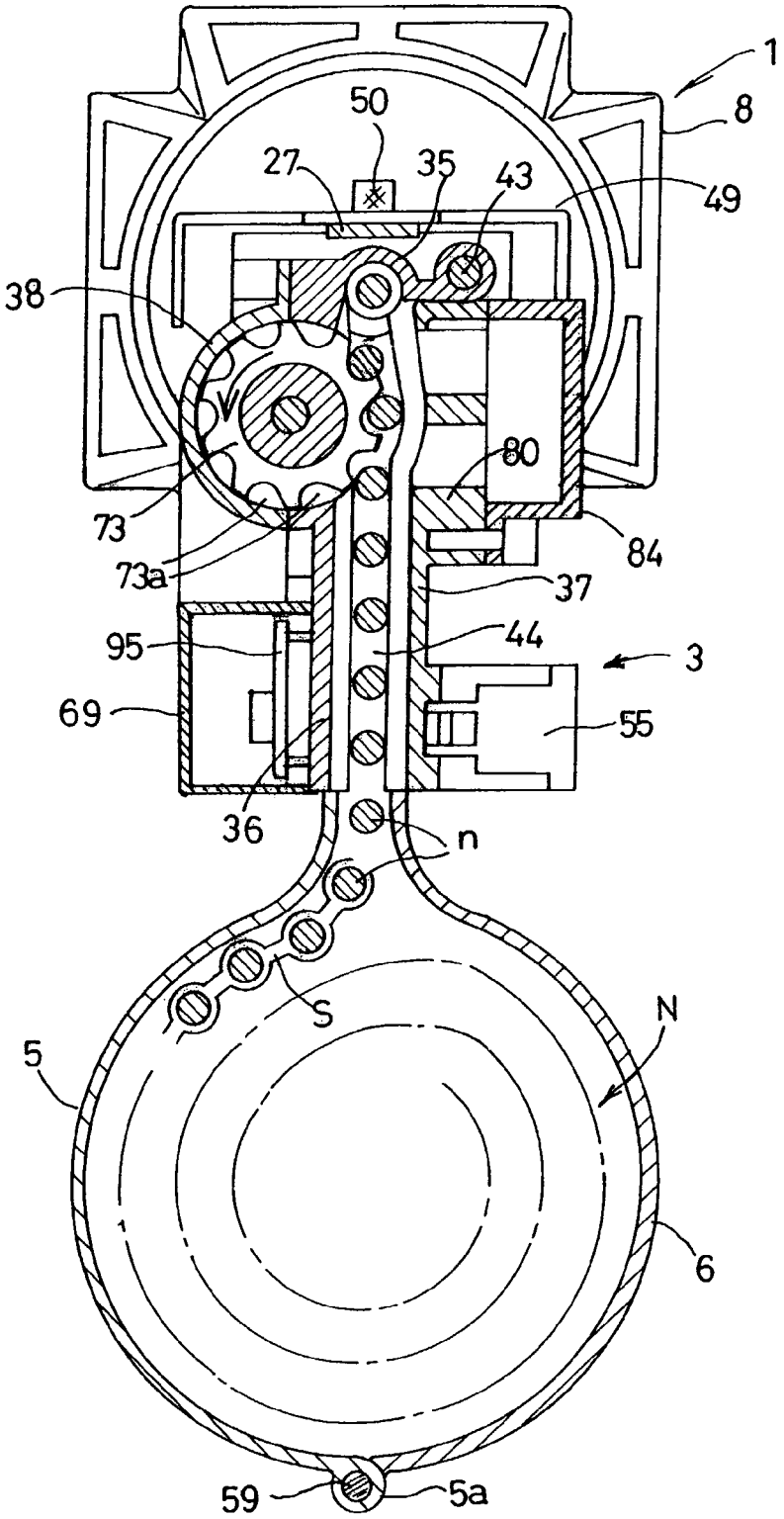
FIG. 18 is a sectional view of FIG. 12 and FIG. 13 seen along XVIII-XVIII.

Next, we shall provide a detailed description of the nail feed mechanism by referring to FIG. 15 through FIG. 21. FIG. 15 is a left lateral view of the main guide body 36 when the gear unit 46 is attached. FIG. 16 is a left lateral view showing the relation of the positions of the gear unit 45 and the nail connecting body N. FIG. 17 is a sectional view of FIG. 12 along XVII-XVII. FIG. 18 is a sectional view of FIG. 12 and FIG. 13 along XVIII-XVIII. FIG. 19 is a sectional view of FIG. 5 and FIG. 21 along XIX-XIX. FIG. 20 is an exploded inclined view used to explain the state indicated in FIG. 19. FIG. 21 is a right lateral view of the upper part of the head part 3. FIG. 22 is a sectional view of FIG. 21 along XXII-XXII.

The gear unit 46 is provided with—starting from the front—(a) a slave gear 72; (b) three feed gears 73; and (c) a rotation detection gear 74. These are fixed to a single center shaft 75 by screws and the like. Both ends of the center shaft 75 are supported by a bearing 76 so that it can rotate freely. Each of the gears 72, 73 and 74 are retained so that they cannot be displaced in the axial direction. The three feed gears 73 are formed so that they form an integral piece with a single shaft (these may also be formed separately from one another).

The slave gear 72 is a twisting gear (helical gear) which causes the gear teeth to slope along the shaft line. The drive gear 78 which is attached to the main shaft 77 of the feed motor 47 engages with this slave gear 72. The drive gear 78 also is a twisting gear which causes the gear teeth to slope along the shaft line. When the shaft lines of the slave gear 72 and the drive gear 78 intersect as indicated in the mode of carrying out the present invention, an interlocking mechanism which is made up of a level gear and a worm gear and an interlocking mechanism which is made up of a pair of bevel gears may be used.

The feed gear 73 is exposed in the nail guide space 44 for the nail n. As a result, a first window hole 79 which is used to expose the feed gear 73 in the nail guide space is formed on the main guide body 36 as indicated in FIG. 18 and FIG. 11.

The tooth profile of the feed gear 73 is indicated in FIG. 18 and FIG. 19. The nail connecting bodies N are fed in one pitch increments by interlocking with the shaft of the nail n. In this mode of carrying out the present invention, ten gear teeth 73*a* are formed on the feed gear 73, however, the number of gear teeth 73*a* may be set to any number depending on the relation to the outside diameter. In addition, each of the gear teeth 73*a* are formed so that the front part extends in a schematic straight line toward the direction of rotation when the rear surface is shaped like a circular arc when seen from the side towards the direction of rotation. This makes it easy to draw the nail n out.

As can be seen from FIG. 16, the two feed gears 73 are disposed so that they engage with the nail n on both sides which clamp the two connecting materials S. As a result, this is a state whereby the two connecting tools S are drawn out simultaneously by the feed gear 73. Therefore, it is advantageous in that the nail is retained so that it is parallel to the shaft line of the guide tube 35 and the nail connecting bodies N are fed accurately.

(6) Means for Stabilizing Nail Feeding

As indicated in FIG. 19 and FIG. 20, the nail connecting body N is pressed toward the gear unit 46 by two presser rollers 80—upper and lower—as an example of the presser means. This makes it possible to prevent the nail connecting body N from drifting so that the nails n can be fed accurately to the guide tube 35.

The presser roller 80 is attached by a shaft running forward and back in the lengthwise direction on a bearing tool 82 which looks like a box with the left side missing when seen on a plane. It fits into the holder part 81 which is formed on the subguide body 37 and it is pressed by the spring 83. The spring 83 fits into the spring case 84. The spring case 84 is fixed to the holder part 81 by the screw 85.

Then, a hole on the holder part 81 is made so that it is a square hole so that the presser roller 80 is retained at a position where it is level. In addition, upper and lower bulging parts 82*b* are formed on the back surface part 82*a* of the bearing fitting 82 and a step part 86 (counterbore hole) is formed on the square hole of the holder part 81, with which the bulging parts 82*b* on the bearing fitting 82 fit and slide easily. The presser roller 80 is permitted to go backward to a certain extent so that it resists the spring 83.

Thus, the presser roller 80 moves both far away from and close to the gear unit 46 in resistance to the spring 83 so that the nail connecting body N is retained at a position where it does not drift so that the feed process is not impeded. In addition, the group of nails n is able to secure a state whereby it engages securely with the feed gear 73. Further, the pressure means for the nail connecting body N is not necessarily restricted to a presser roller and another type of member such as a lever shaped member may also be used. A plate spring presser member may also be used. The presser roller 80 has been omitted in FIG. 18.

As indicated in FIG. 21 and FIG. 22, a position retaining lever 87 which is used to retain the position of the nail n is attached at a site which approaches the front part of the subguide body 37. This position retaining lever 87 is exposed to the nail guide space from the second window hole 88 which opens onto the subguide body 37.

This position retaining lever 87 is provided with a support part 87*a* which supports one nail n just before it moves to the guide tube 35. At the same time, the upper end surface is formed as the guide surface 87*b* which has a curved radius which is slightly larger than the outer diameter of the head a1 of the nail n when seen from the front. Then, the lower end of the position retaining lever 87 is connected to the second bracket part 89 which is disposed so that it protrudes outward from the subguide body 37 with a pin 90 both in front and in the rear in a lengthwise direction.

Therefore, the position retaining lever 87 turns to the left and right while centering on the lower end part of this. In addition, by using a twisting spring 92, it inclines toward the main guide body 36 and is pressed in the direction of rotation. As a result, the position retaining lever 87 rotates in resistance to the spring thus permitting the feeding of the nail connecting body N. In addition, the position retaining lever 87 brings a site which is somewhat higher than the center of rotation is brought into contact with the inclined stopper part 91 of the subguide body 37 so that the position which leans toward the main guide body 36 is regulated.

Although it is supplementary explanation, when the position retaining lever 87 is completely inclined towards the main guide body 36, the guide surface 87*b* of the upper end of this becomes concentric with the guide tube 35 when seen from the front. As a result, the head a1 of the nail which is driven out is guided it as it passes through and is able to go forward directly. In addition, by supporting the succeeding nails n using a support part 87*a*, a position which is parallel to the guide tube 35 can be retained in conjunction with each of the feed gears 73 even if the nails n are long.

Although in case of using a long nail n, retaining it at a precise position is possible by disposing the multiple feed gears 73 at wide intervals, but when the feed motor 47 is disposed at a position which is near to the front side of the head part 3 like this mode of carrying out the present invention, the feed gear 73 cannot be disposed at a location which is near to the front side of the head part 3.

On the other hand, if the group of feed gears 73 is disposed so that it approaches the rear part of the head part 3, as indicated in the mode of carrying out the present invention and the position retaining lever 87 is set in place at a location which is on the front side of the head part 3, the degree of freedom of disposing the feed motor 47 can be ensured and the long nails can be retained at an exact position which makes the invention advantageous.

The motor 47 may be disposed on the upper surface part of the head part 3, however, in this disposition it is difficult to design the nose member 27 and it is difficult for the operator to see the surface being worked on during operations. As a result, when placed on one of the left and right surface parts of the head part 3, as indicated in this mode of the invention, this is suitable as malfunctions such as interference with the nose member 27 and difficulty in seeing the surface being worked on can be avoided. In addition, a feed device such as the motor 47 and the gear unit 46 should be disposed on a fixed member such as the main guide body 36.

(7) Supplementary Explanation of Nail Feeding

For example, as can easily be seen from FIG. 22, part of the outside of the radius of the gear unit 46 in the nail guide space 44 is formed on the circular groove 44*a* which has a moderate curvature which is centered on the shaft center (rotation shaft center of the feed gear 73) of the gear unit 46. A rectilinear part 44*b* extends from the upper end of this circular groove 44*a* towards the nail guide tube 35.

Needless to say, however, it can be configured so that the nail guide space 44 extends in a rectilinear direction from the magazine 4. On the other hand, the engagement (latching) of the feed gear 73 with the nail is strongest at a part which is exactly horizontal to the shaft center and the engaging function with the nail n declines the farther away it goes from the side position to both upwards and downwards.

Then, when the nail guide space is a simple shape such that is extends in a rectilinear fashion up and down, the shaft center of the feed gear 73 must be distanced from the nail guide space 44. Therefore, the catching function of the nail n on the gear tooth 73*a* deteriorates and as a result, it may not be possible to ensure that the feed gear 73 and the group of nails will engage sufficiently.

On the other hand, when the nail guide space 44 is formed in shape it extends in a circular shape right beside the feed gear 73, the length at which the group of nails and the feed gear 73 engaged can be made longer circumferentially so that the meshing depth of the group of nails and the feed gear 73 can be ensured and the group of nails can be fed reliably.

In addition, setting in a presser roller 80 is suitable since the engagement of the feed gear 73 and group of nails can be made more reliable.

(8) Control of Nail Feed

Next, we shall explain how the feeding of nails n is controlled by mainly referring to FIG. 23 through FIG. 26. FIG. 23 is a sectional view of FIG. 12 and FIG. 13 along XXIII-XXIII. FIG. 24 is a sectional view of FIG. 12 and FIG. 13 along XXIV-XXIV. FIG. 25 is an explanatory diagram indicating the relationships in the electrical system. FIG. 26 is an explanatory view indicating the control relationship of the feed motor 47, the braking circuit 48 and the sensors.

In this mode of carrying out the present invention, the control means for driving out the nails n is provided with (a) a first sensor 93 which is used to detect the movement of the rod 17; (b) a second sensor 94 which is used to detect the nails n when they are fed; and (c) a control circuit which controls the feed motor 47 as well as the braking circuit 48 based on the movement of these sensors 93 and 94.

As indicated in FIG. 15 and FIG. 18, the control circuit is provided with a circuit substrate 95. The circuit substrate 95 is attached to the left side surface of the main guide body 36. In addition, the circuit substrate 95 is covered by a protective cover 69. The protective cover 69 is fixed to the main guide body 36 by the screw 96. The protective cover 69 has an extension part 69*a* which extends as far as the front end part of the main guide body 36. As indicated previously, the fixed member 5 of the magazine 4 is pressed down and retained by this extension part 69*a*.

As indicated in FIG. 23 and FIG. 24, the first sensor 93 is disposed on the pocket part 97 which is formed on the rear part of the main guide body 36 and the gear cover 38 so that these communicate with one another. The first sensor 93 uses a limit switch (microswitch) which is provided with a movable contact 93*a*. This movable contact 93*a* is disposed slightly in front of the rod 17 which is located at the position of regression.

The main body of the first sensor 93 is fixed to either the main guide body 36 or the gear cover 38. The terminal 98 is exposed outside the gear cover 38 via a hole. The terminal 98 and the circuit substrate 95 are connected by a cable 100 which is provided with a plug 99. This terminal has been omitted from FIG. 24.

As indicated in FIG. 15 and FIG. 23, the second sensor 94 is fixed to the main guide body 36 and is covered by a hollow part 97*a* on the gear cover 38. This second sensor 94 makes use of a limit switch (microswitch) which is provided with a contact 94*a*. The contact 94*a* is brought into contact with the circumferential surface of the rotation detection gear 74.

The profile of each of the teeth of the rotation detection gear 74 is formed like a gently sloping angle. This makes it possible to ensure that the movement of the contact 94*a* of the second sensor 94 is smooth. Needless to say, the number of gear teeth in the rotation detection gear 74 coincides with the number of gear teeth of the feed gear 73. The signal cable 100 of the second sensor is connected to the circuit substrate 95.

Further, in this mode of carrying out the present invention, the detection of the nail was carried out instead by the rotation detection gear 74, however it can also be configured so that the nails nearest to the guide tube 35 are detected directly by the second sensor 74.

As indicated in FIG. 25, a drive system 101 which controls the driving out of the nails and a feed system 102 which controls the feed of the nails n are present in the nail driving device as an electrical system. The drive system 101 is provided with a battery 13, an ignition plug 25, a fan motor 20, a trigger switch 104 which is turned on when the trigger 10 is pulled and a control circuit (not shown in the figure).

On the other hand, the feed system 102 is provided with a feed motor 47, a first sensor 93, a second sensor 94 and a control circuit 105 which includes a braking circuit 48. Then, electric power is provided from the battery 13 in the drive system as a power source for the feed system 102. The control circuit is provided with a microcomputer. The braking circuit 48 is one part of the control circuit, however, in FIG. 25, it is indicated separately from the control circuit 105 to facilitate the explanation.

FIG. 26 indicates in terms of a time series how the feed motor 47 and the braking circuit 48 and both sensors 93 and 94 are related in the feed system 102. The energizing status of the feed motor 47 and the braking circuit 48 is ON.

In the first sensor 93, the state wherein the contact 93*a* does not make contact with the rod 17 (that is, the state wherein the rod 17 has completely regressed) is detected as ON. In addition, in the second sensor 94, the state wherein the contact 94*a* moves from trough to trough of the rotation detection gear 74 (in other words, the state wherein the rotation gear 74 which does double duty turns at 1 pitch) is detected as ON.

Further, it is preferable that ON and OFF in both sensors 93 and 94 are unrelated to whether or not there is an energizing state, in order to conserve power consumption, process the energizing interception state for the first sensor 93 as an ON signal and the energizing state should be processed as an OFF signal. The second sensor 9 is processed so that the energizing state is ON.

Then, when the first sensor 93 goes from OFF to ON and the feed motor 47 starts driving, after a short time lag, the second sensor 94 goes ON (the rotation detection gear 74 turns when the feed motor 47 turns, however, there is somewhat of a time lag while the movement of the contact 94*a* changes to signals. As a result, the ON operation of the second sensor 94 is somewhat delayed after the start of feed motor 47.

Then, when each of the gears 72, 73 and 74 turn the nail connecting body N at an angle at which one pitch is sent, the second sensor 94 is switched from ON to OFF as the contact 94*a* moves from trough to trough on the rotation detection gear 74. The feed motor 47 stops being driven by the signal changes from ON to OFF in the second sensor 94 and after a very short time has passed (for example, two hundred or three hundred microseconds), the braking circuit 48 goes ON and the inertial rotation of the feed motor 47 is prevented.

The first sensor 93 should be ON for the feed motor 47 to be turned, therefore the feed motor 47 would not turn without the rod 17 completely going backwards and as the result burned-out and other types of malfunctions are prevented.

However, when the energizing of the feed motor 47 and the energizing of the braking circuit 48 overlap, this leads to burned-out of the feed motor 47 and excess consumption of electric power. In addition, there is a very small time lag between (a) the rotation starting terminal and the rotation ending terminal of contact and (b) the sending of the signals in the second sensor 94. The contact 94*a* of the second sensor 94 goes past the peak and before completely entering the trough of the rotation detection gear 74 the OFF signal appears on the second sensor 94 (in other words, before each of the gears 72, 73 and 74 turn thoroughly to a predetermined angle).

Therefore, if each of the gears 72, 73 and 74 stop turning at the same time that the OFF signals of the second sensor 94 are sent, it is possible that the actual rotation angle will be slightly smaller than the angle required to feed a one-pitch of nail connecting body N.

On the other hand, when a slight time difference is set from the time the feed motor 47 is turned on OFF to the time when the braking circuit 48 is turned ON, as indicated in the mode of carrying out the present invention, simultaneous energizing to the feed motor 47 and to the braking circuit 48 is prevented. At the same time, the time lag between the rotation of the contact 94*a* of the second sensor 94 and the signals sent is absorbed and each of the gears 72, 73 and 74 can be rotated accurately in accordance with the extent of the standard angle.

In addition, if the feed is controlled only by the rotation of the feed gear 73, it is possible that small errors will accumulate while the nails are repeatedly driven and it will no longer be possible to feed the nails n accurately.

On the other hand, in this mode of carrying out the present invention, the feed motor 47 can be stopped reliably each and every time by turning the second sensor 94 OFF. As a result, the slight time difference in the rotation of the gears 72, 73 and 74 can be adjusted (reset) so that it is no longer necessary to set an encoder to detect the rotation of the feed motor 47 accurately thus making it eminently practical.

A safety circuit which is used to stop the energizing process if a larger load than permitted is placed on the feed motor 47 is disposed on the control circuit to prevent the feed motor 47 from becoming damaged when an excess load is placed for some reason such as the nails becoming jammed.

Further, when the rod 17 moves forward even though a nail n has not been supplied to the guide tube 35, the fuel is wasted. Therefore, (a) the ignition of the ignition plug 25 when the trigger switch 104 is ON may be made a condition and (b) the ON state for the second sensor 94 may be made conditions as well. A typical example of this is indicated by the dotted line scheme in FIG. 25.

When the nail n is fed using the feed gear 73—as was the case in this mode of carrying out the present invention—the rotation torque of the feed gear 73 is constant so that the load on the feed motor 47 is constant. As a result, it is advantageous in that the rotation of the feed gear 73 can be stabilized.

(10). Second Mode of Carrying Out the Present Invention (FIG. 27 Through FIG. 29)

A second mode of carrying out the present invention is indicated in FIG. 27 through FIG. 29. FIG. 27 is a partial lateral view of the nail connecting body N. FIG. 28 is a sectional view of FIG. 27 seen along XXVIII-XXVIII. FIG. 29 (A) is a schematic diagram indicating the nail connecting bodies N when they are being fed. FIG. 29 (B) is a view of FIG. 29 (A) seen along B-B.

In this mode of carrying out the present invention, the connecting material S is provided with a substrate 51 which extends far out in a belt or band shape. Multiple groups of side pieces S2 which retain the nail n are disposed on both side edges in the length direction of the substrate 51. In addition, the outside surface of the substrate 51 and the front end of the side pieces S2 are set so that they are arranged on the periphery of the head of the nail n. As a result, the nail connecting body N may be wound exactly in a coil shape without any loss.

Then, holes for latching S3 are placed at a constant pitch on the substrate 51 and it engages the feed gear (sprocket) 73 with the latching hole S3. The connecting material S can be manufactured using a sheet material such as a resinous sheet or paper. Needless to say, it can be made of resin, manufactured by injection molding. Slits can also be disposed on side piece S2 to make it easier for the nails n to fall out.

(11). Third Mode of Carrying Out the Present Invention (FIG. 30)

Figure 30:
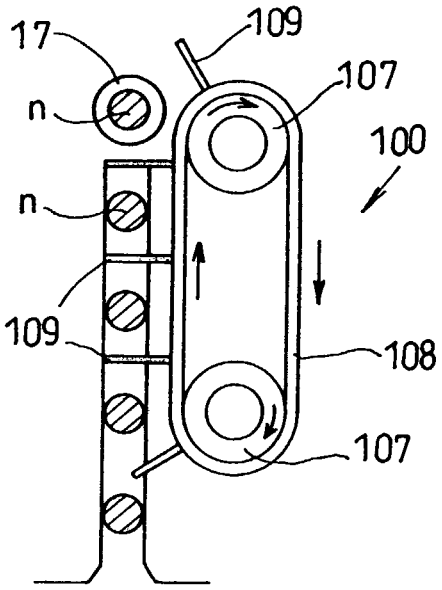
FIG. 30 is a schematic diagram of the third mode of carrying out the present invention.

FIG. 30 indicates the principle of the third mode of carrying out the present invention. In this mode, an endless feeder 110 which is made by placing hooking protrusion 109 so that it protrudes at predetermined intervals on endless belt 108 which is wound around a pair of pulleys 107 as a rotary type feed member.

A timing belt or a chain can be used as the endless belt. Once the nail n has been fed to the highest level, the hooking protrusion 109 which is positioned on the highest level is structured so that it retreats without interfering with the rod 17.

(12). Other

The invention in the present application may be realized in a variety of other modes besides those indicated above. For example, the structure and shape of the individual members may be set at will as long as the function which is the object of the invention is not adversely affected. Specifically, the head part can be a single structure. The member which makes up the head part can also form an integral piece with the main body (this means that the component member of the main body and the component member of the head part can be common).

In addition, when the rotary type feed member is driven using an electrical actuator, a piezo-electric element which generates electricity by pressing the nose member to the workpiece can be disposed at an appropriate location on the head part and the main body. The electrical power which is generated by this piezo-electric element can be accumulated in a battery and used as a power source for the feed means. A rotary solenoid may also be used as a drive means for the rotary type feed member. In addition, the reciprocating movement of the movable body (movable core) in the reciprocating electromagnetic solenoid can be converted to turn the rotary type feed member by means of turning mechanism like a crank mechanism.

The fastener retaining means such as a magazine and the head part can be made so that they have an integral structure. In addition, each of the configurations disclosed in this Specification and in the figures may constitute a separate claim as an invention which can be broadly applied for a driving tool.

The invention claimed is:

1. A portable fastener driving tool, comprising:
- a main body including a combustion chamber;
- a rod moveable within the main body to be driven forward by gas combustion or explosion in said combustion chamber;
- a head part disposed at a front end of the main body and having a fastener guiding part;
- a magazine removably attachable to the head part and for storing a plurality of fasteners connected with each other by a fastener connecting body; and
- a power operated fastener feeding mechanism comprising:
  - a rotary feed member for feeding the fasteners one by one into the fastener guiding part to be driven from the head part by forward movement of the rod; and
  - an electric motor for driving the rotary feed member,
- wherein the rotary feed member comprises
- at least a rotary feed gear coupled to be driven by the motor and engageable with the fastener connecting body or the fasteners, for feeding the fasteners one by one into the fastener guiding part; and
- a rotation detection gear rotatable together with the rotary feed gear and arranged coaxially with the rotary feed gear, for indicating a feeding of each of the fasteners into the fastener guiding part.

2. The tool of claim 1, wherein
- the magazine has a shape of a drum for housing the fastener connecting body wound either in a coil shape or a roll shape.

3. The tool of claim 1, wherein the fastener feeding mechanism further comprises:
- a first sensor for detecting a retracted position of the rod;
- a second sensor for detecting the feeding of one of the fasteners into the fastener guiding part;
- a brake for controllably stopping the motor from rotating the rotary feed gear; and
- a control circuit for
  - causing the motor to rotate the rotary feed gear for feeding one of the fasteners into the fastener guiding part upon a first detection of the first sensor that the rod is in the retracted position, and
  - energizing the brake to stop the motor from rotating upon a second detection of the second sensor that one of the fasteners has been fed into the fastener guiding part.

4. The tool of claim 3, wherein the second sensor is arranged for detecting a rotation of the rotary feed gear, said rotation being sufficient for feeding one of the fasteners into the fastener guiding part.

5. The tool of claim 3, wherein
- the rotation detection gear has a plurality of troughs,
- the second sensor comprises a contact member positionable in any one of said troughs; and
- a movement of the contact member from one trough to an adjacent trough, due to a rotation of the rotation detection gear together with the rotary feed gear, corresponds to the feeding of one of the fasteners into the fastener guiding part.

6. The tool of claim 5, wherein
- the rotary feed gear and the rotation detection gear have the same number of teeth.

7. The tool of claim 3, wherein the first sensor comprises a contact member contactable with said rod except at said retracted position, thereby detecting the rod being in the retracted position when the contact member does not contact the rod.

8. The tool of claim 3, wherein the control circuit is arranged for, in response to the second detection of the second sensor that one of the fasteners has been fed into the fastener guiding part, turning off the motor before energizing the brake.

9. The tool of claim 1, wherein the rotary feed gear is disposed at the head part.

10. The tool of claim 1, wherein the rotary feed member comprises multiple said rotary feed gears for respectively engaging different parts of the fastener connecting body or different parts of the fasteners to be fed.

11. The tool of claim 1, wherein said rotation detection gear and the rotary feed gear are integrally fixed to a single shaft, and the electric motor is free of direct attachment to the rotation detection gear and the rotary feed gear.

12. An explosively actuated fastener driving tool, comprising:

an explosively actuated fastener driving mechanism for driving a rod forward by gas combustion or explosion in a combustion chamber associated with said rod; and an electrically powered fastener feeding mechanism for feeding fasteners from a magazine associated with said tool to the fastener driving mechanism, wherein the electrically powered fastener feeding mechanism comprises a rotary feed gear for feeding the fasteners one by one to the fastener driving mechanism; and a rotation detection gear rotatable together with the rotary feed gear and arranged coaxially with the rotary feed gear, for indicating a feeding of each of the fasteners into the fastener driving mechanism.

13. The tool of claim 12, wherein the fastener feeding mechanism further comprises an electric motor for driving the rotary feed gear.

14. The tool of claim 13, wherein the fastener feeding mechanism further comprises:

a brake for controllably stopping the motor from rotating the rotary feed gear; and a control circuit for causing the motor to rotate the rotary feed gear for feeding one of the fasteners to the fastener driving mechanism upon a first detection that a fastener driving element of the fastener driving mechanism is in a retracted position, and energizing the brake to stop the motor from rotating upon a second detection that one of the fasteners has been fed to the fastener driving mechanism.

15. The tool of claim 14, wherein the control circuit is arranged for, in response to the second detection that one of the fasteners has been fed to the fastener driving mechanism, turning off the motor before energizing the brake.

16. The tool of claim 12, wherein said rotation detection gear and the rotary feed gear are disposed on a common rotational shaft, and the electric motor is coupled to rotate said rotational shaft via a slave gear on said shaft.

17. A combustion-powered fastener driving tool, comprising:

a combustion-powered fastener driving mechanism for driving a rod forward by gas combustion or explosion in a combustion chamber associated with said rod; and an electrically powered fastener feeding mechanism for feeding fasteners from a magazine associated with said tool to the fastener driving mechanism, wherein the electrically powered fastener feeding mechanism comprises a rotary feed gear for feeding the fasteners one by one to the fastener driving mechanism; and a rotation detection gear rotatable together with the rotary feed gear and arranged coaxially with the rotary feed gear, for indicating a feeding of each of the fasteners into the fastener driving mechanism.

18. The tool of claim 17, wherein the fastener feeding mechanism further comprises an electric motor for driving the rotary feed gear.

19. The tool of claim 18, wherein the fastener feeding mechanism further comprises:

a brake for controllably stopping the motor from rotating the rotary feed gear; and a control circuit for causing the motor to rotate the rotary feed gear for feeding one of the fasteners to the fastener driving mechanism upon a first detection that a fastener driving element of the fastener driving mechanism is in a retracted position, and energizing the brake to stop the motor from rotating upon a second detection that one of the fasteners has been fed to the fastener driving mechanism.

20. The tool of claim 19, wherein the control circuit is arranged for, in response to the second detection that one of the fasteners has been fed to the fastener driving mechanism, turning off the motor before energizing the brake.

21. The tool of claim 17, wherein said rotation detection gear and the rotary feed gear are disposed on a common rotational shaft, and the electric motor has a main shaft inclined with respect to said rotational shaft, and coupled with said rotational shaft via a twisting gear.

* * * * *